US010620557B2

(12) United States Patent
Sawada et al.

(10) Patent No.: US 10,620,557 B2
(45) Date of Patent: Apr. 14, 2020

(54) TONER, TONER SET, TONER ACCOMMODATING UNIT, IMAGE FORMING METHOD, AND IMAGE FORMING APPARATUS

(71) Applicants: Toyoshi Sawada, Shizuoka (JP); Kazumi Suzuki, Shizuoka (JP); Yu Naito, Shizuoka (JP); Akihiro Kaneko, Shizuoka (JP)

(72) Inventors: Toyoshi Sawada, Shizuoka (JP); Kazumi Suzuki, Shizuoka (JP); Yu Naito, Shizuoka (JP); Akihiro Kaneko, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/515,103

(22) Filed: Jul. 18, 2019

(65) Prior Publication Data

US 2020/0033745 A1 Jan. 30, 2020

(30) Foreign Application Priority Data

Jul. 30, 2018 (JP) ..... 2018-142609

(51) Int. Cl.

| | |
|---|---|
| ***G03G 9/08*** | (2006.01) |
| ***G03G 9/09*** | (2006.01) |
| ***G03G 9/087*** | (2006.01) |
| ***G03G 15/01*** | (2006.01) |
| ***G03G 15/08*** | (2006.01) |

(52) U.S. Cl.

CPC ..... *G03G 9/0924* (2013.01); *G03G 9/08755* (2013.01); *G03G 9/0926* (2013.01); *G03G 15/0121* (2013.01); *G03G 15/0865* (2013.01)

(58) Field of Classification Search

CPC ..... G03G 9/0924; G03G 9/0926
USPC ..... 430/111.4
See application file for complete search history.

(56) References Cited

U.S. PATENT DOCUMENTS

| | | | | |
|---|---|---|---|---|
| 2002/0132177 | A1 | 9/2002 | Sawada et al. | |
| 2003/0039909 | A1 | 2/2003 | Sawada et al. | |
| 2003/0129518 | A1 | 7/2003 | Sawada et al. | |
| 2003/0134214 | A1* | 7/2003 | Nakamura | G03G 9/0918 430/107.1 |
| 2003/0219670 | A1 | 11/2003 | Sawada et al. | |
| 2005/0250037 | A1 | 11/2005 | Sawada et al. | |

(Continued)

FOREIGN PATENT DOCUMENTS

| | | |
|---|---|---|
| JP | 2001-265181 | 9/2001 |
| JP | 2005-099295 | 4/2005 |

(Continued)

OTHER PUBLICATIONS

U.S. Appl. No. 16/210,003, filed Dec. 5, 2018, Toyoshi Sawada, et al.

(Continued)

*Primary Examiner* — Mark A Chapman
(74) *Attorney, Agent, or Firm* — Oblon, McClelland, Maier & Neustadt, L.L.P.

(57) ABSTRACT

A toner comprising a binder resin and a near-infrared light absorbing material is provided. The toner in the form of a pellet has: a chroma C* of 20 or less in the L*C*h color space; a hue angle h of from 50 to 90 degrees in the L*C*h color space; and a spectral reflectance of 5% or less at a wavelength of from 800 to 900 nm.

20 Claims, 9 Drawing Sheets

(56) References Cited

U.S. PATENT DOCUMENTS

| | | | | |
|---|---|---|---|---|
| 2005/0277046 | A1 | 12/2005 | Sawada et al. | |
| 2006/0072943 | A1 | 4/2006 | Suzuki et al. | |
| 2007/0071511 | A1 | 3/2007 | Suzuki et al. | |
| 2007/0218386 | A1 | 9/2007 | Suzuki et al. | |
| 2008/0076055 | A1 | 3/2008 | Sawada et al. | |
| 2008/0292985 | A1 | 11/2008 | Suzuki et al. | |
| 2009/0016786 | A1 | 1/2009 | Suzuki et al. | |
| 2009/0042118 | A1 | 2/2009 | Suzuki et al. | |
| 2009/0098477 | A1* | 4/2009 | Carter, Jr. ..... | G03G 9/0902 430/108.21 |
| 2009/0142093 | A1 | 6/2009 | Sawada et al. | |
| 2009/0142094 | A1 | 6/2009 | Sawada et al. | |
| 2010/0203437 | A1 | 8/2010 | Yanagida | |
| 2011/0129775 | A1 | 6/2011 | Sawada et al. | |
| 2011/0177447 | A1 | 7/2011 | Suzuki et al. | |
| 2012/0082926 | A1 | 4/2012 | Suzuki et al. | |
| 2012/0202147 | A1 | 8/2012 | Suzuki et al. | |
| 2013/0017480 | A1 | 1/2013 | Suzuki et al. | |
| 2013/0330522 | A1 | 12/2013 | Suzuki et al. | |
| 2014/0023966 | A1 | 1/2014 | Sawada et al. | |
| 2014/0080051 | A1 | 3/2014 | Sawada et al. | |
| 2014/0272690 | A1 | 9/2014 | Suzuki et al. | |
| 2015/0030819 | A1 | 1/2015 | Naito et al. | |
| 2015/0248074 | A1 | 9/2015 | Suzuki et al. | |
| 2015/0253685 | A1 | 9/2015 | Suzuki et al. | |
| 2017/0139337 | A1 | 5/2017 | Kaneko et al. | |
| 2019/0086834 | A1 | 3/2019 | Suzuki et al. | |

FOREIGN PATENT DOCUMENTS

| | | |
|---|---|---|
| JP | 2007-003944 | 1/2007 |
| JP | 2007-171508 | 7/2007 |
| JP | 2010-113368 | 5/2010 |
| JP | 2017-102343 | 6/2017 |
| JP | 2017-128039 | 7/2017 |
| JP | 2017-128040 | 7/2017 |
| JP | 2017-129803 | 7/2017 |
| JP | 2019-001983 | 1/2019 |
| WO | WO 2018/062052 A1 | 4/2018 |
| WO | WO 2018/230486 A1 | 12/2018 |

OTHER PUBLICATIONS

U.S. Appl. No. 16/333,892, filed Sep. 22, 2017, Kazumi Suzuki, et al.

Extended European Search Report dated Dec. 2, 2019, in Patent Application No. 19188255.4, 7 pages.

* cited by examiner

TONER, TONER SET, TONER ACCOMMODATING UNIT, IMAGE FORMING METHOD, AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2018-142609, filed on Jul. 30, 2018 in the Japan Patent Office, the entire disclosure of which is hereby incorporated by reference herein.

BACKGROUND

Technical Field

The present disclosure relates to a toner, a toner set, a toner accommodating unit, an image forming method, and an image forming apparatus.

Description of the Related Art

Additional data embedding techniques for embedding additional information in an image by superimposition are known.

In recent years, additional data embedding techniques have been actively used for copyright protection (e.g., illegal copy protection) of digital works such as still images. As an example, for the case in which a digital work is printed on a recording medium by an image forming apparatus, a technique for embedding information as to the image forming apparatus is known. The technique involves forming an invisible pattern (i.e., an image difficult to visually recognize) on the recording medium together with the digital work.

An invisible pattern can be read by utilizing infrared absorption. For example, one proposed technique involves recording an image with a normal color toner and another image with an infrared-absorbing-material-containing colorless toner ("invisible toner") in parallel or in layers such that the two image are substantially unidentifiable or indistinguishable by naked eyes.

In addition, another proposed technique involves forming an invisible toner image and a color toner image such that the gloss value of the invisible toner image is lower than that of the color toner image, so as not to impair the image quality of the color toner image provided in the same area as the invisible toner image on a recording medium when the color toner image is visually observed.

SUMMARY

In accordance with an embodiment of the present invention, a toner is provided. The toner comprises a binder resin and a near-infrared light absorbing material. The toner in the form of a pellet has a chroma C* of 20 or less in the L*C*h color space, a hue angle h of from 50 to 90 degrees in the L*C*h color space, and a spectral reflectance of 5% or less at a wavelength of from 800 to 900 nm.

In accordance with an embodiment of the present invention, a toner set is provided. The toner set includes a color toner comprising a binder resin and a colorant, and the above-described toner.

In accordance with an embodiment of the present invention, a toner accommodating unit is provided. The toner accommodating unit includes a container and the above-described toner accommodated in the container.

In accordance with an embodiment of the present invention, an image forming method is provided. The image forming method includes the processes of forming an electrostatic latent image on an electrostatic latent image bearer, developing the electrostatic latent image formed on the electrostatic latent image bearer with the above-described toner to form an invisible toner image, transferring the invisible toner image formed on the electrostatic latent image bearer onto a surface of a recording medium, and fixing the invisible toner image on the surface of the recording medium.

In accordance with an embodiment of the present invention, an image forming apparatus is provided. The image forming apparatus includes: an electrostatic latent image bearer; an electrostatic latent image forming device configured to form an electrostatic latent image on the electrostatic latent image bearer; a developing device containing the above-described toner, configured to develop the electrostatic latent image formed on the electrostatic latent image bearer with the toner to form an invisible toner image; a transfer device configured to transfer the invisible toner image formed on the electrostatic latent image bearer onto a surface of a recording medium; and a fixing device configured to fix the invisible toner image on the surface of the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
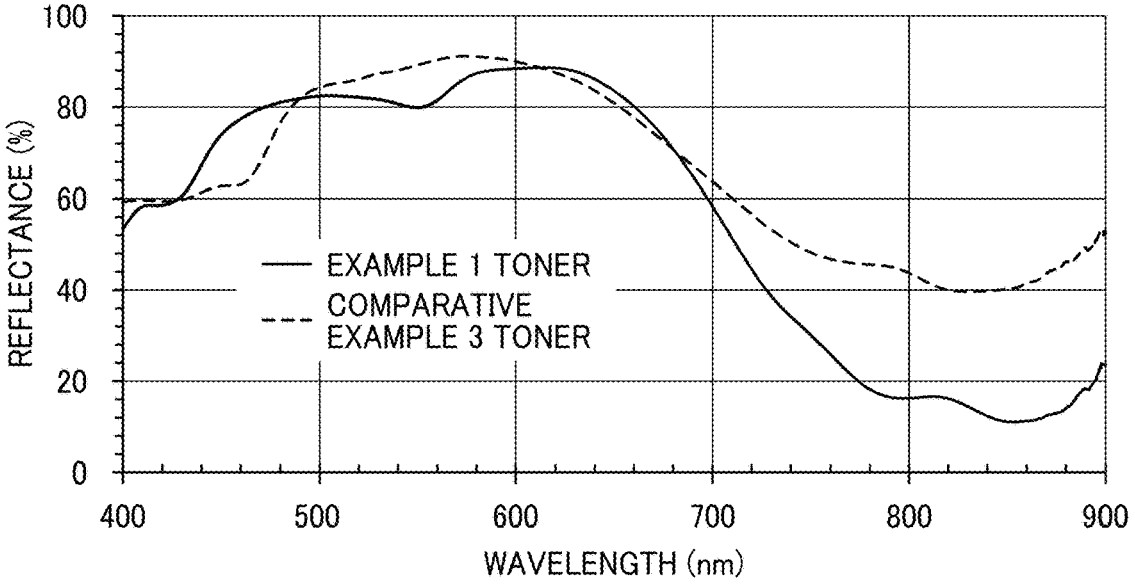
FIG. 1 is a graph showing spectral reflectance curves of solid images formed of respective toners of Example 1 and Comparative Example 3 with a toner deposition amount of 0.6 mg/cm$^2$.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

According to an embodiment of the present invention, a toner having excellent invisibility and readability is provided.

As a result of intensive studies, the inventors of the present invention have found the following.

That is, an invisible toner is required to absorb near-infrared light having a wavelength of 700 to 900 nm and to reflect visible light having a wavelength of 400 nm to 700 nm for their invisibility under visible light, as indicated by a spectral reflectance curve of a solid image formed of toner of Example 1, with a toner deposition amount of 0.6 mg/cm$^2$, illustrated in FIG. 1.

As near-infrared light absorbing materials, phthalocyanines such as naphthalocyanine have been mainstream so far. A phthalocyanine-based near-infrared light absorbing material has a greenish or bluish color in the L*a*b* color space, as indicated by toner of Comparative Example 3 in FIG. 2.

Figure 2:
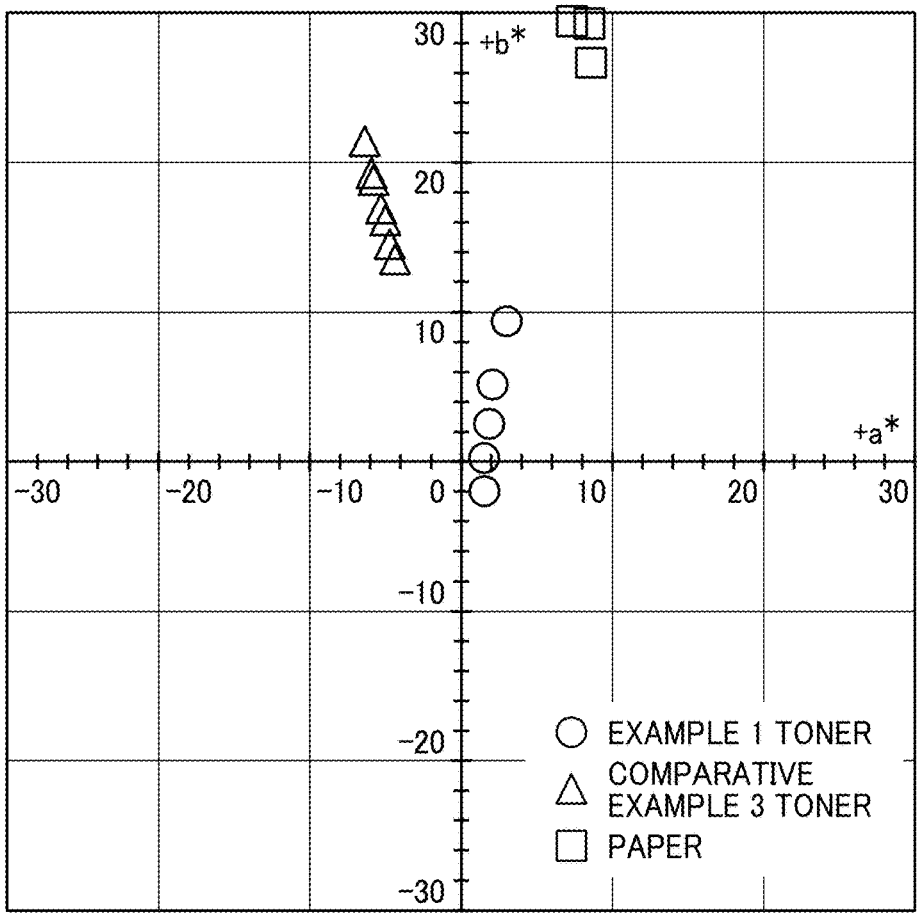
FIG. 2 is a graph showing the L*a*b* color space for solid images formed of respective toners of Example 1 and Comparative Example 3 with a toner deposition amount of 0.6 mg/cm$^2$.

When the conventional invisible toner is recorded on a recording medium such as paper and stored for a long time, the recording medium gets deteriorated and discolored to be reddish over time as illustrated in FIG. 2, thus lowering invisibility of the invisible toner that has a greenish or bluish color on the recording medium.

Here, FIG. 2 illustrates the L*a*b* color space for solid images formed of respective toners of Example 1 and Comparative Example 3 with a toner deposition amount of 0.6 mg/cm$^2$.

As a result of intensive studies, the inventors of the present invention have achieved an invisible toner that provides excellent invisibility and readability even after being recorded on a recording medium and stored for a long term. This invisible toner has, when in the form of a pellet, a chroma C* of 20 or less in the L*C*h color space, a hue angle h of from 50 to 90 degrees in the L*C*h color space, and a spectral reflectance of 5% or less at a wavelength of from 800 to 900 nm.

The inventors have also found that, when this invisible toner is recorded on a recording medium together with a color toner, invisibility of the invisible toner is increased as the color toner conceals the invisible toner without impairing readability.

Toner

A toner according to an embodiment of the present invention comprises a binder resin and a near-infrared light absorbing material, and the toner in the form of a pellet has a chroma C* of 20 or less in the L*C*h color space, a hue angle h of from 50 to 90 degrees in the L*C*h color space, and a spectral reflectance of 5% or less at a wavelength of from 800 to 900 nm.

Hereinafter, the toner according to an embodiment of the present invention is referred to as "invisible toner" to be distinguished from "color toner" to be described later.

Chroma C* and Hue Angle h of Toner in Pellet Form

The invisible toner according to an embodiment of the present invention has, when in the form of a pellet, a chroma C* of 20 or less, preferably from 6 to 19, in the L*C*h color space, for improving invisibility and readability of the invisible toner image.

When the chroma C* of the pellet is 20 or less, the invisible toner on a recording medium provides excellent invisibility even when the recording medium (e.g., paper) gets deteriorated and discolored by ultraviolet light with time, because the changes in the chroma C* and hue angle h of the invisible toner are small.

The invisible toner according to an embodiment of the present invention has, when in the form of a pellet, a hue angle h of from 50 to 90 degrees, preferably from 53 to 88 degrees, in the L*C*h color space, for improving invisibility and readability of the invisible toner image.

When the hue angle h of the pellet is from 50 to 90 degrees, the invisible toner on a recording medium provides excellent invisibility even when the recording medium (e.g., paper) gets deteriorated and discolored by ultraviolet light with time, because the changes in the chroma C* and hue angle h of the invisible toner are small.

The chroma C* and the hue angle h of the pellet can be measured with a spectrophotometer (X-Rite eXact available from X-Rite Inc., status A, m0 light source).

The pellet can be prepared by molding the toner into a pellet shape.

The molding may be performed by a molding machine (BRE-32 available from MAEKAWA TESTING MACHINE MFG. Co., Ltd.) with a pressing device load of 6 Mpa, a pressing time of 1 minute, and a pellet diameter of 40 mm.

Spectral Reflectance of Toner in Pellet Form

The invisible toner according to an embodiment of the present invention has, when in the form of a pellet, a spectral reflectance of 5% or less, preferably from 1.8% to 4.8%, at a wavelength of from 800 to 900 nm, for improving invisibility and readability of the invisible toner image.

When the spectral reflectance of the pellet at a wavelength of from 800 to 900 nm is 5% or less, even when a recording medium (e.g., paper) gets deteriorated and discolored by ultraviolet light with time, reduction of readability of the invisible toner under infra-red light irradiation is prevented.

The spectral reflectance of the pellet can be measured with a spectrophotometer (V-660 available from JASCO Corporation, equipped with an ISN-723 integrating sphere unit).

The pellet used for measuring the spectral reflectance is the same as the above-described pellet used for measuring the chroma C* and the hue angle h.

Invisible Toner

The invisible toner according to an embodiment of the present invention contains at least a binder resin and a near-infrared light absorbing material, and further contains other components, as necessary.

Binder Resin

The invisible toner contains at least a binder resin.

Examples of the binder resin include, but are not limited to, styrene resin, polyester resin, vinyl chloride resin, rosin-modified maleic acid resin, phenol resin, epoxy resin, polyethylene resin, polypropylene resin, ionomer resin, polyurethane resin, silicone resin, ketone resin, xylene resin, petroleum resin, and hydrogenated petroleum resin.

Examples of the styrene resin include, but are not limited to, polystyrene, α-methyl styrene polymer, chlorostyrene polymer, styrene-propylene copolymer, styrene-butadiene copolymer, styrene-vinyl chloride copolymer, styrene-vinyl acetate copolymer, styrene-maleic acid copolymer, styrene-acrylate copolymer, styrene-methacrylate copolymer, and styrene-acrylonitrile-acrylate copolymer.

Each of these materials can be used alone or in combination with others.

Among these, polyester resin is preferable.

Since polyester resin is more reddish compared to styrene resin, acrylic resin, and styrene-acrylic resin, the invisible toner on a recording medium provides excellent invisibility even when the recording medium (e.g., paper) gets deteriorated and discolored by ultraviolet light with time, because the changes in the chroma C* and hue angle h of the invisible toner are small.

The polyester resin can be obtained by a polycondensation reaction between an alcohol and an acid which are commonly known.

Examples of the alcohol include, but are not limited to, divalent alcohol monomers and trivalent or higher alcohol monomers.

Examples of the divalent alcohol monomers include, but are not limited to, diols, etherified bisphenols, and divalent alcohol monomers obtained by substituting the aforementioned compounds with a saturated or unsaturated hydrocarbon group having 3 to 22 carbon atoms.

Examples of the diols include, but are not limited to, polyethylene glycol, diethylene glycol, triethylene glycol, 1,2-propylene glycol, 1,3-propylene glycol, 1,4-propylene glycol, neopentyl glycol, 1,4-butenediol, and 1,4-bis(hydroxymethyl)cyclohexane.

Examples of the etherified bisphenols include, but are not limited to, bisphenol A, hydrogenated bisphenol A, polyoxyethylenated bisphenol A, and polyoxypropylenated bisphenol A.

Examples of the trivalent or higher alcohol monomers include, but are not limited to, sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Each of these materials can be used alone or in combination with others.

The acid is not particularly limited and may be appropriately selected according to the purpose, but a carboxylic acid is preferable.

Specific examples of the carboxylic acid include, but are not limited to: monocarboxylic acids such as palmitic acid, stearic acid, and oleic acid; maleic acid, fumaric acid, mesaconic acid, citraconic acid, terephthalic acid, cyclohexanedicarboxylic acid, succinic acid, adipic acid, sebacic acid, and malonic acid, and divalent organic acid monomers obtained by substituting these acids with a saturated or unsaturated hydrocarbon group having 3 to 22 carbon atoms; anhydrides of these acids; dimers of lower alkyl esters and linolenic acid; 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, and enpol trimer acid; and trivalent or higher polyvalent carboxylic acid monomers such as anhydrides of the above acids. Each of these materials can be used alone or in combination with others.

The binder resin may contain a crystalline resin.

The crystalline resin is not particularly limited and can be appropriately selected according to the purpose as long as it has crystallinity. Examples thereof include, but are not limited to, polyester resin, polyurethane resin, polyurea resin, polyamide resin, polyether resin, vinyl resin, and modified crystalline resin. Each of these materials can be used alone or in combination with others.

Among these, polyester resin, polyurethane resin, polyurea resin, polyamide resin, and polyether resin are preferable. In particular, a resin having at least one of a urethane backbone and a urea backbone is preferable for imparting moisture resistance and incompatibility with an amorphous resin (to be described later).

Near-Infrared Light Absorbing Material

The invisible toner contains at least a near-infrared light absorbing material.

The near-infrared light absorbing material is not particularly limited and can be appropriately selected according to the purpose as long as it has a reddish hue. Examples thereof include, but are not limited to, cyanine dyes, nickel dithiolene complexes, squarylium dyes, quinone compounds, diimonium compounds, and azo compounds. Among these, squarylium dyes are preferable.

Organic near-infrared light absorbing materials have better dispersibility in the binder resin than inorganic near-infrared light absorbing materials, and can be uniformly dispersed in an invisible image formed on an image output medium. Therefore, invisibility is unlikely to be impaired in the visible light region. In the infrared light region, the light is sufficiently absorbed, so that information can be recorded at a high density. Furthermore, since dispersibility in toner is good, machine reading and decoding process of the invisible image can be reliably performed for an extended period of time.

The near-infrared light absorbing material is preferably dispersed in the toner particles.

When the near-infrared light absorbing material is externally fixed on the surface of the toner particles or mixed in the toner particles, aggregation may occur in the toner particles or developer. Even when a necessary amount of the near-infrared light absorbing material is added as a bulk, a part thereof is lost due to adhesion to equipment in the process of externally fixing it on the surface of the toner particles or preparing a developer, causing lack or uneven distribution of the near-infrared light absorbing material in the invisible toner image. As a result, information cannot be read out accurately and stably. In addition, liberated particles of the near-infrared light absorbing material may contaminate the inside of the machine, particularly a photoconductor, thus adversely affecting other processes such as development and transfer.

The proportion of the near-infrared light absorbing material in the invisible toner varies depending on the property of the material, but is preferably from 0.3% to 1.0% by mass.

When the proportion is 0.3% by mass or more, absorption of near-infrared light is sufficient and the deposition amount of the invisible toner is not too large, so that visibility is excellent. When the proportion is 1.0% by mass or less, absorption of visible light is reduced and invisibility is excellent.

The chroma C* and hue angle h in the L*C*h color space and the spectral reflectance can be adjusted by adjusting the proportion of the near-infrared light absorbing material.

Confirmation of presence of the near-infrared light absorbing material in the toner and quantification thereof can be performed in the following manner. [Specimen Treatment] A specimen is prepared by dropping 1 μL of a 20% methanol solution of tetramethylammonium hydroxide (TMAH) as a methylating agent into about 1 mg of a sample.

[Measurement Conditions]

Pyrolysis-gas chromatography-mass spectrometer (Py-GCMS)

Analysis equipment: QP2010 available from Shimadzu Corporation

Heating furnace: Py2020D available from Frontier Laboratories Ltd.

Heating temperature: 320 degrees C.

Column: ULTRA ALLOY-5L available from Frontier Laboratories Ltd., having a length of 30 m, an inner diameter of 0.25 mm, and an average film thickness of 0.25 μm Column temperature conditions: Held at 50 degrees C. for 1 minute, raised at a temperature rising rate of 10 degrees C./min, and held at 340 degrees C. for 7 minutes.

Split ratio: (1:100)

Column flow rate: 1.0 mL/min

Ionization method: EI method (70 eV)

Measurement mode: Scan mode

Search data: NIST 20 MASS SPECTRAL LIB. (made by National Institute of Standards and Technology)

Alternatively, confirmation of presence of the near-infrared light absorbing material in the toner and quantification thereof can be performed in the following manner.

[Specimen Treatment]

(1) For $^{1}$H-NMR: A specimen is prepared by dissolving about 40 to 50 mg of a sample in about 0.7 mL (d=1.48) of $CDCl_3$ containing TMS.

(2) For $^{13}$C-NMR: A specimen is prepared by dissolving about 250 to 260 mg of a sample in about 0.7 mL (d=1.48) of $CDCl_3$ containing TMS.

[Measuring Device and Measurement Conditions]

ECX-500 NMR (nuclear magnetic resonance) apparatus (available from JEOL Ltd.)

(1) Measurement nucleus: $^{1}$H (500 MHz), measurement pulse file: single pulse. ex2 ($^{1}$H), 45° pulse, integration: 16 times, relaxation delay: 5 seconds, data point: 32 K, observation width: 15 ppm (2) Measurement nucleus: $^{13}$C (125 MHz), measurement pulse file: single pulse dec. ex2 ($^{1}$H), 30° pulse, integration: 1,000 times (1,039 times for RNC-501), relaxation delay: 2 seconds, data point: 32 K, offset: 100 ppm, observation width: 250 ppm Other Components The other components are not particularly limited and can be appropriately selected according to the purpose as long as they are generally contained in toner. Examples thereof include, but are not limited to, a release agent, a charge control agent, and an external additive.

Release Agent

The release agent is not particularly limited and can be appropriately selected according to the purpose. Examples thereof include, but are not limited to, natural waxes and synthetic waxes which are conventionally known.

Specific examples of conventionally-known natural waxes include, but are not limited to: plant waxes such as carnauba wax, cotton wax, sumac wax, and rice wax; animal waxes such as beeswax and lanolin; mineral waxes such as ozokerite and ceresin; and petroleum waxes such as paraffin, microcrystalline, and petrolatum.

Specific examples of conventionally-known synthetic waxes include, but are not limited to: synthetic hydrocarbon waxes such as Fischer-Tropsch wax and polyethylene wax; synthetic waxes such as esters, ketones, and ethers; fatty acid amides such as 1,2-hydroxystearic acid amide, stearic acid amide, phthalic anhydride imide, and chlorinated hydrocarbons; and low-molecular-weight crystalline polymers, such as homopolymers and copolymers of polyacrylates such as n-stearyl polymethacrylate and n-lauryl polymethacrylate (e.g., n-stearyl acrylate-ethyl methacrylate copolymer), which have a long-chain alkyl group on a side chain.

Each of these materials can be used alone or in combination with others.

Preferably, the release agent comprises an ester wax.

Preferred examples of the ester wax include a monoester wax. The monoester wax easily exudes out to the surface of the toner at the time the toner gets fixed because of its low compatibility with general binder resins. Thus, the toner exhibits high releasability while securing high degrees of gloss and low-temperature fixability.

Preferred examples of the monoester wax include a synthetic ester wax.

Examples of the synthetic ester wax include, but are not limited to, a monoester wax synthesized from a long-chain linear saturated fatty acid and a long-chain linear saturated alcohol.

The long-chain linear saturated fatty acid is represented by the general formula $C_nH_{2n+1}COOH$, and one having n of about 5 to 28 is preferable.

Specific examples of the long-chain linear saturated fatty acid include, but are not limited to, capric acid, undecylic acid, lauric acid, tridecylic acid, myristic acid, pentadecylic acid, palmitic acid, heptadecanoic acid, tetradecanoic acid, stearic acid, nonadecanoic acid, behenic acid, lignoceric acid, cerotic acid, heptacosanoic acid, montanic acid, and melissic acid.

The long-chain linear saturated alcohol is represented by the general formula $C_nH_{2n+1}OH$, and n is preferably from 5 to 28.

Specific examples of the long-chain linear saturated alcohol include, but are not limited to, amyl alcohol, hexyl alcohol, heptyl alcohol, octyl alcohol, capryl alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol, and heptadecanol. These may have a substituent such as a lower alkyl group, an amino group, and a halogen.

Preferably, the release agent has a melting point of from 50 to 120 degrees C. When the melting point of the release agent is 50 degrees C. or above, deterioration of heat-resistant storage stability of the toner can be prevented. When the melting point of the release agent is 120 degrees C. or below, deterioration of cold offset resistance and the occurrence of paper winding on a fixing device can be prevented.

More specifically, when the melting point of the release agent is from 50 to 120 degrees C., the release agent can effectively act at the interface between a fixing roller and the toner, thereby improving high-temperature offset resistance of the toner without applying another release agent such as an oil to the fixing roller.

The melting point of the release agent can be determined from the maximum endothermic peak measured by a differential scanning calorimeter (TG-DSC system TAS-100 available from Rigaku Corporation).

The proportion of the release agent to the binder resin is preferably from 1% to 20% by mass, more preferably from 3% to 10% by mass. When the proportion is 1% by mass or more, offset resistance is excellent. When the proportion is 20% by mass or less, transferability and durability are excellent.

The amount of the monoester wax contained in 100 parts by mass of the invisible toner is preferably from 4 to 8 parts by mass, more preferably from 5 to 7 parts by mass. When the amount is 4 parts by mass or more, the release agent well exudes out to the surface of the toner at the time the toner gets fixed, and the toner are excellent in releasability, gloss value, low-temperature fixability, and high-temperature offset resistance. When the amount is 8 parts by mass or less, the amount of the release agent deposited on the surface of the toner is prevented from increasing, thereby improving storage stability and resistance to filming (on a photoconductor, etc.) of the toner.

Preferably, the toner contains a wax dispersing agent.

The wax dispersing agent has an effect of dispersing the wax in the toner, so that storage stability of the toner is reliably improved regardless of production method of the toner. In addition, the diameter of the wax is reduced due to the effect of the wax dispersing agent, so that the toner is prevented from filming on a photoconductor, etc.

Preferably, the wax dispersing agent is a copolymer composition comprising at least styrene, butyl acrylate, and acrylonitrile as monomers, or a polyethylene adduct of the copolymer composition.

The amount of the wax dispersing agent contained in 100 parts by mass of the invisible toner is preferably 7 parts by mass or less. When the amount is 7 parts by mass or less, the amount of components which are compatible with the binder resin is increased and excellent gloss is provided. Also, the wax sufficiently exudes out to the surface of the toner at the time the toner gets fixed, thus improving low-temperature fixability and hot offset resistance.

Charge Control Agent

The charge control agent is not particularly limited and can be appropriately selected according to the purpose. Specific examples thereof include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, fluorine activators, metal salts of salicylic acid, and metal salts of salicylic acid derivatives. Each of these materials can be used alone or in combination with others.

The charge control agent is not particularly limited and commercially-available products may be used.

Specific examples of commercially-available products include, but are not limited to: BONTRON 03, BONTRON P-51, BONTRON S-34, E-82, E-84, and E-89 (available from Orient Chemical Industries Co., Ltd.); TP-302, TP-415, COPY CHARGE PSY VP2038, COPY BLUE PR, COPY CHARGE NEG VP2036, and COPY CHARGE NX VP434 (available from Hoechst AG); and LRA-901 and LR-147 (available from Japan Carlit Co., Ltd.).

The amount of the charge control agent contained in the toner can be appropriately determined depending on the type of the binder resin, the presence or absence of an additive, and/or the toner production method including dispersing method. Preferably, the amount of the charge control agent with respect to 100 parts by mass of the binder resin is from 0.1 to 5 parts by mass, more preferably from 0.2 to 2 parts by mass. When the amount is 5 parts by mass or less, chargeability of the toner is not so large that the electrostatic attractive force between the toner and a developing roller, fluidity of the developer, and image density are excellent.

Among the above charge control agents, trivalent or higher metal salts are capable of controlling thermal properties of the toner. Such a metal salt undergoes a cross-linking reaction with an acidic group of the binder resin at the time when the toner gets fixed to form a weak three-dimensional cross-linkage, whereby the toner achieves high-temperature offset resistance while maintaining low-temperature fixability.

Examples of the metal salt include, but are not limited to, a metal salt of a salicylic acid derivative and a metal salt of acetylacetonate.

The metal is not particularly limited and can be appropriately selected according to the purpose as long as it is a trivalent or higher polyvalent ionic metal. Examples thereof include, but are not limited to, iron, zirconium, aluminum, titanium, and nickel. Among these, trivalent or higher metal compounds of salicylic acid are preferable.

The amount of the metal salt contained in the toner is not particularly limited and may be appropriately selected according to the purpose. Preferably, the amount of the metal salt contained in 100 parts by mass of the invisible toner is in the range of from 0.5 to 2 parts by mass, more preferably from 0.5 to 1 part by mass. When the amount is 0.5 parts by mass or more, hot offset resistance is excellent. When the amount is 2 parts by mass or less, gloss property is excellent.

External Additive

The external additive may be contained in the toner to assist fluidity, developability, and chargeability of the toner. The external additive is not particularly limited and may be appropriately selected according to the purpose. Examples thereof include, but are not limited to, fine inorganic particles and fine polymeric particles.

Specific examples of the fine inorganic particles include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Each of these materials can be used alone or in combination with others.

Specific examples of the fine polymeric particles include, but are not limited to, polystyrene particles obtained by soap-free emulsion polymerization, suspension polymerization, or dispersion polymerization; particles of copolymer of methacrylates and/or acrylates; particles of polycondensation polymer such as silicone, benzoguanamine, and nylon; and thermosetting resin particles.

The external additive may be surface-treated with a surface treatment agent to improve its hydrophobicity to prevent deterioration of fluidity and chargeability even under high-humidity conditions.

Specific examples of the surface treatment agent include, but are not limited to, silane coupling agents, silylation agents, silane coupling agents having a fluorinated alkyl group, organic titanate coupling agents, aluminum coupling agents, silicone oils, and modified silicone oils.

The external additive preferably has a primary particle diameter of from 5 nm to 2 μm, and more preferably from 5 to 500 nm.

The external additive preferably has a specific surface area in the range of from 20 to 500 $m^2/g$, measured according to the BET method.

Preferably, the proportion of the external additive in the invisible toner is from 0.01% to 5% by mass, more preferably from 0.01% to 2.0% by mass.

Cleanability Improving Agent

A cleanability improving agent may be contained in the toner to remove residual developer remaining on a photoconductor or primary transfer medium after image transfer.

Specific examples of the cleanability improving agent include, but are not limited to: metal salts of fatty acids, such as zinc stearate and calcium stearate; and fine particles of polymers prepared by soap-free emulsion polymerization etc., such as fine polymethyl methacrylate particles and fine polystyrene particles. Preferably, the particle size distribution of the fine polymer particles is relatively narrow and the volume average particle diameter thereof is in the range of from 0.01 to 1 μm.

Chroma C* and Hue Angle h of Solid Image

A solid image formed of the invisible toner according to an embodiment of the present invention (with a toner deposition amount of 0.6 $mg/cm^2$) preferably has a chroma C* of 20 or less in the L*C*h color space.

When the chroma C* of the solid image is 20 or less, the invisible toner on a recording medium (on which the solid image is formed) provides excellent invisibility even when the recording medium (e.g., paper) gets deteriorated and discolored by ultraviolet light with time, because the changes in the chroma C* and hue angle h of the invisible toner are small.

The solid image formed of the invisible toner according to an embodiment of the present invention (with a toner deposition amount of 0.6 $mg/cm^2$) preferably has a hue angle h of from 50 to 90 degrees in the L*C*h color space.

When the hue angle h of the solid image is from 50 to 90 degrees, the invisible toner on a recording medium (on which the solid image is formed) provides excellent invisibility even when the recording medium (e.g., paper) gets deteriorated and discolored by ultraviolet light with time, because the changes in the chroma C* and hue angle h of the invisible toner are small.

The chroma C* and the hue angle h of the solid image can be measured in the same manner as those of the pellet.

The solid image can be formed by putting a two-component developer containing the toner according to an embodiment of the present invention in a developing unit and adjusting the developing unit to output a solid image with a deposition amount of 0.60 $mg/cm^2$ on a recording medium.

The developing unit may be, for example, an apparatus named MP C3503 (available from Ricoh Co., Ltd.).

The recording medium may be, for example, a product named POD GLOSS PAPER (available from Oji Paper Co., Ltd.).

Here, the deposition amount refers to the amount of toner which is deposited on a transfer paper sheet.

Spectral Reflectance of Solid Image

The solid image formed of the invisible toner according to an embodiment of the present invention (with a toner deposition amount of 0.6 $mg/cm^2$) has a spectral reflectance of 40% or less at a wavelength of from 800 to 900 nm.

When the spectral reflectance at a wavelength of from 800 to 900 nm of the solid image is 40% or less, even when a recording medium (e.g., paper) gets deteriorated and discolored by ultraviolet light with time, reduction of readability of the invisible toner under infra-red light irradiation is prevented.

The spectral reflectance of the solid image can be measured in the same manner as that of the pellet.

The solid image used for measuring the spectral reflectance is the same as the above-described solid image used for measuring the chroma C* and the hue angle h.

Weight Average Molecular Weight Mw and Number Average Molecular Weight Mn

The weight average molecular weight Mw of the invisible toner is preferably from 6,000 to 12,000, more preferably from 7,500 to 10,000.

The ratio (Mw/Mn) of the weight average molecular weight Mw to the number average molecular weight Mn of the invisible toner is preferably 5 or less, more preferably 4 or less.

The weight average molecular weight can be determined from a molecular weight distribution of tetrahydrofuran (THF)-soluble matter that is measured by a gel permeation chromatography (GPC) measuring instrument.

As the GPC measuring instrument, for example, a device named GPC-150C (available from Waters Corporation) may be used.

The weight average molecular weight Mw and the number average molecular weight Mn can be measured by gel permeation chromatography as follows.

First, columns are stabilized in a heat chamber at 40 degrees C., and THF as a solvent is let to flow at a flow rate of 1 mL/min. Next, 0.05 g of a sample (invisible toner) is thoroughly dissolved in 5 g of THF and thereafter filtered with a pretreatment filter, so that a THF solution of the sample having a sample concentration of from 0.05% to 0.6% by mass is prepared. The THF solution of the sample thus prepared in an amount of from 50 to 200 μL is injected in the measuring instrument.

Next, a calibration curve of molecular weight distribution is created using several monodisperse polystyrene standard samples.

The weight average molecular weight Mw and the number average molecular weight Mn of THF-soluble matter in the invisible toner are determined by comparing the molecular weight distribution of the invisible toner with the calibration curve created with several types of monodisperse polystyrene standard samples that shows the relation between the logarithmic values of molecular weights and the number of counts.

The polystyrene standard samples may be, for example, those having molecular weights of $6\times10^2$, $2.1\times10^2$, $4\times10^2$, $1.75\times10^4$, $5.1\times10^4$, $1.1\times10^5$, $3.9\times10^5$, $8.6\times10^5$, $2\times10^6$, and $4.48\times10^6$, respectively (available from Pressure Chemical Company or Tosoh Corporation).

Preferably, the calibration curve is created using at least 10 standard polystyrene samples.

As the columns, for example, SHODEX KF801 to 807 (available from SHOWA DENKO K.K.) can be used.

As the pre-treatment filter, for example, CHROMATODISC (available from KURABO INDUSTRIES LTD., having a pore diameter of 0.45 μm) can be used.

As a detector, for example, a refractive index (RI) detector can be used.

Glass Transition Temperature Tg

The glass transition temperature Tg of the invisible toner is preferably from 45 to 75 degrees C., more preferably from 50 to 60 degrees C., for heat-resistant storage stability.

When the glass transition temperature Tg of the invisible toner is 45 degrees C. or higher, heat-resistant storage stability and hot offset resistance are improved. In addition, invisibility of the invisible toner image is improved since the gloss value of the invisible toner image is maintained without increasing the difference from that of a recording medium (e.g., paper) or a color toner image.

When the glass transition temperature Tg of the invisible toner is 75 degrees C. or lower, low-temperature fixability is improved since the minimum fixable temperature of the toner is prevented from increasing. In addition, invisibility of the invisible toner image is improved since the gloss value of the invisible toner image is maintained without increasing the difference from that of a recording medium (e.g., paper) or a color toner image.

The glass transition temperature Tg of the invisible toner can be measured by a differential scanning calorimeter as follows.

First, 0.01 to 0.02 g of a sample is weighed in an aluminum pan, and the temperature is raised to 200 degrees C. Next, the temperature is lowered to 0 degrees C. at a temperature falling rate of 10 degrees C./min, then the sample is heated at a temperature rising rate of 10 degrees C./min. The glass transition temperature Tg of the toner is determined as a temperature at the intersection of an extended line of a base line of the endothermic curve at or below the temperature of the highest peak, and a tangent line of the endothermic curve which indicates the maximum slope between the peak rising portion and the peak top.

As the differential scanning calorimeter, for example, a device named DSC210 (available from Seiko Instruments Inc.) can be used.

½ Outflow Temperature $T_{F1/2}$

The ½ outflow temperature $T_{F1/2}$ is preferably from 90 to 150 degrees C., more preferably from 105 to 120 degrees C., for heat-resistant storage stability.

When the $T_{F1/2}$ is 90 degrees C. or higher, heat-resistant storage stability and hot offset resistance are improved. In addition, invisibility of the invisible toner image is improved since the gloss value of the invisible toner image is maintained without increasing the difference from that of a recording medium (e.g., paper) or a color toner image.

When the $T_{F1/2}$ is 150 degrees C. or lower, low-temperature fixability is improved since the minimum fixable temperature of the toner is maintained. In addition, invisibility of the invisible toner image is improved since the gloss value of the invisible toner image is maintained without increasing the difference from that of a recording medium (e.g., paper) or a color toner image.

$T_{F1/2}$ can be Measured by a Flowtester as Follows.

First, 1 g of a sample is applied with a load of 1.96 MPa by a plunger while being heated at a temperature rising rate of 6 degrees C./min and extruded from a nozzle having a diameter of 1 mm and a length of 1 mm. The amount of drop of the plunger of the flowtester is plotted against the temperature, and the temperature at which the half of the sample has flowed out is taken as the ½ outflow temperature $T_{F1/2}$.

As the flowtester, for example, a device named CFT-500D (available from Shimadzu Corporation) can be used.

Difference in 60-Degree Gloss Value Between Solid Image of Invisible Toner and Recording Medium Preferably, the difference in 60-degree gloss value between a solid image formed of the invisible toner and a recording medium is 10 or less. In this case, visibility of the invisible toner image due to the gloss value difference is reduced and invisibility is excellent.

The gloss value of the solid image of the invisible toner can be adjusted by, for example, adjusting the gel fraction in the binder resin or adjusting the weight average molecular weight of the binder resin.

The greater the gel fraction in the binder resin, the lower the gloss value. The closer the gel fraction to 0, the higher the gloss value.

In a case in which the binder resin is free of gel, the greater the weight average molecular weight of the binder resin, the lower the gloss value. In addition, the smaller the weight average molecular weight, the higher the gloss value.

Preferably, the gel fraction in the invisible toner is 2% by mass or less.

The gel fraction can be calculated from the dry weight of the component filtered by the pretreatment filter that is used for measuring weight average molecular weight.

When the binder resin comprises a resin having an acid value, the gloss value can be adjusted by adding a trivalent or higher metal salt thereto. As the acid value of the binder resin and the added amount of the metal salt increase, the gloss value is likely to become lower. As the acid value of the binder resin and the added amount of the metal salt decrease, the gloss value is likely to become higher.

Weight Average Particle Diameter (D4) and Number Average Particle Diameter (D1)

The weight average particle diameter (D4) of the invisible toner is preferably from 5 to 7 μm, more preferably from 5 to 6 μm.

When the weight average particle diameter (D4) of the invisible toner is from 5 to 7 μm, minute dots with 600 dpi or more can be reproduced and high quality images can be obtained. This is because the particle diameter of the toner particles is sufficiently smaller than minute dots of a latent image and thus excellent dot reproducibility is exhibited.

In particular, the invisible toner particles transferred onto an image output medium are arranged at high density before getting fixed thereon, so that color toner particles superimposed on the invisible toner particles do not enter the gap between the invisible toner particles. Thus, the resulting fixed image can be obtained with high reproducibility. The image obtained with high reproducibility can be more reliably read by a machine upon infrared light irradiation.

The ratio (D4/D1) of the weight average particle diameter (D4) to the number average particle diameter (D1) is preferably from 1.00 to 1.40, more preferably from 1.05 to 1.30.

The closer the ratio (D4/D1) to 1.00, the narrower the particle diameter distribution.

Such a toner having a small particle diameter and a narrow particle diameter distribution has a uniform charge amount distribution and thereby provides a high-quality image with less background fog. In addition, in an electrostatic transfer method, the transfer rate is increased.

The particle size distribution of toner particles can be measured using an apparatus for measuring the particle size distribution of toner particles by the Coulter principle.

Examples of such an apparatus include, but are not limited to, COULTER COUNTER TA II and COULTER MULTISIZER II (both available from Beckman Coulter Inc.).

Specific measurement procedures are as follows.

First, 0.1 to 5 mL of a surfactant (e.g., an alkylbenzene sulfonate), as a dispersant, is added to 100 to 150 mL of an electrolyte solution. Here, the electrolyte solution is an about 1% NaCl aqueous solution prepared with the first grade sodium chloride. As the electrolyte solution, for example, ISOTON-II (available from Beckman Coulter, Inc.) can be used.

Further, 2 to 20 mg of a sample is added thereto. The electrolyte solution in which the sample is suspended is subjected to a dispersion treatment using an ultrasonic disperser for about 1 to 3 minutes and then to the measurement of the weight and number of toner particles using the above-described instrument equipped with a 100-μm aperture to calculate weight and number distributions. The weight average particle diameter (D4) and number average particle diameter (D1) of the toner can be calculated from the weight and number distributions obtained above.

Thirteen channels with the following ranges are used for the measurement: not less than 2.00 μm and less than 2.52 μm; not less than 2.52 μm and less than 3.17 μm; not less than 3.17 μm and less than 4.00 μm; not less than 4.00 μm and less than 5.04 μm; not less than 5.04 μm and less than 6.35 μm; not less than 6.35 μm and less than 8.00 μm; not less than 8.00 μm and less than 10.08 μm; not less than 10.08 μM and less than 12.70 μm; not less than 12.70 μm and less than 16.00 μm; not less than 16.00 μm and less than 20.20 μm; not less than 20.20 μm and less than 25.40 μm; not less than 25.40 μm and less than 32.00 μm; and not less than 32.00 μm and less than 40.30 μm. Namely, particles having a particle diameter not less than 2.00 μm and less than 40.30 μm are to be measured.

Toner Set

The toner set according to an embodiment of the present invention includes a color toner comprising a binder resin and a colorant and further includes the above-described toner, that is, the invisible toner according to an embodiment of the present invention.

Color Toner

The color toner contains a binder resin and a colorant, and further contains other components, as necessary.

Examples of the other components include the same components as the other components in the invisible toner.

Preferably, the color toner is any one of a cyan toner, a magenta toner, a yellow toner, and a black toner. More preferably, the color toner includes a cyan toner, a magenta toner, a yellow toner, and a black toner.

Binder Resin

The binder resin contained in the color toner is not particularly limited and can be appropriately selected according to the purpose. Examples thereof include, but are not limited to, the above-described binder resin contained in the invisible toner.

Preferably, the binder resin contained in the color toner contains gel.

The proportion of gel, i.e., gel fraction, in the binder resin is preferably in the range of from 0.5% to 20% by mass, more preferably from 1.0% to 10% by mass.

A toner image formed of the color toner preferably has a gloss value lower than that of general offset printed matter.

Even being free of gel, the binder resin of the color toner preferably contains a high-molecular-weight component having a weight average molecular weight Mw of 100,000 or higher, which is larger than the weight average molecular weight Mw of the binder resin of the invisible toner.

When the weight average molecular weight Mw of the binder resin of the color toner is larger than the weight average molecular weight Mw of the binder resin of the invisible toner, the resulting color image has a 60-degree gloss value of about 10 to 30, which has higher visibility than offset printed matter.

Colorant

As the colorant, those having a small absorption in a wavelength range of 800 nm or higher are preferable. Specific examples of such colorants include, but are not limited to, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarin Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, dioxane violet, Anthraquinone Violet, Chrome Green, zinc green, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, perylene black, perinone black, and mixtures thereof. Each of these materials can be used alone or in combination with others.

When the color toner is used as a process color toner, the following colorants are preferably used for each of black, cyan, magenta, and yellow toners.

For black toner, perylene black and perinone black are preferable.

For cyan toner, C.I. Pigment Blue 15:3 is preferable.

For magenta toner, C.I. Pigment Red 122, C.I. Pigment Red 269, and C.I. Pigment Red 81:4 are preferable.

For yellow toner, C.I. Pigment Yellow 74, C.I. Pigment Yellow 155, C.I. Pigment Yellow 180, and C.I. Pigment Yellow 185 are preferable.

Each of these colorants can be used alone or in combination with others.

Perylene black that contains a compound having a perylene structure and perinone black that contains a compound having a perinone structure are preferably used as black colorants, because they have a high degree of coloring power and are capable of forming a black image that transmits infrared light without being affected by charging property of the toner.

The absorbance of the colorant at 800 nm or higher is preferably less than 0.05, more preferably less than 0.01. When the absorbance is less than 0.05, the color toner superimposed on the invisible toner is prevented from inhibiting reading of information formed of the invisible toner.

The proportion of the colorant in the color toner is preferably from 3% to 12% by mass, more preferably from 5% to 10% by mass, although it depends on the coloring power of each colorant. When the proportion is 3% by mass or more, coloring power is excellent, so that the amount of deposited toner will be appropriate. When the proportion is 12% by mass or less, chargeability of the toner is excellent, so that the amount of toner charge is maintained stable.

Weight Average Particle Diameter (D4) and Number Average Particle Diameter (D1)

The weight average particle diameter (D4) of the color toner is preferably from 4 to 8 μm, more preferably from 5 to 7 μm.

When the weight average particle diameter (D4) of the color toner is 4 μm or more, undesirable phenomena such as reduction of transfer efficiency and deterioration of blade cleaning property can be prevented. When the weight average particle diameter (D4) of the color toner is 8 μm or less, the above-described undesirable phenomenon can be prevented that is disturbance of image caused when the color toner superimposed on an unfixed image gets into the image. In addition, scattering of texts and lines can be easily prevented.

When the weight average particle diameter (D4) of the color toner is from 4 to 8 μm, minute dots with 600 dpi or more can be reproduced and high quality images can be obtained. This is because the particle diameter of the toner particles is sufficiently smaller than minute dots of a latent image and thus excellent dot reproducibility is exhibited.

The ratio (D4/D1) of the weight average particle diameter (D4) to the number average particle diameter (D1) is preferably from 1.00 to 1.40, more preferably from 1.05 to 1.30.

The closer the ratio (D4/D1) to 1.00, the narrower the particle diameter distribution.

Such a toner having a small particle diameter and a narrow particle diameter distribution has a uniform charge amount distribution and thereby provides a high-quality image with less background fog. In addition, in an electrostatic transfer method, the transfer rate is increased.

In a full-color image forming method that forms a multicolor image by superimposing toner images of different colors, the amount of toner deposited on paper is larger compared to a monochrome image forming method that forms an image only with black toner without superimposing toner images of different colors.

Therefore, the amount of toner to be developed, transferred, and fixed is increased, and the above-described undesirable phenomena that deteriorate image quality are likely to occur, such as reduction of transfer efficiency, deterioration of blade cleaning property, scattering of texts and lines, and background fog. Thus, the weight average particle diameter (D4) and the ratio (D4/D1) of the weight average particle diameter (D4) to the number average particle diameter (D1) should be properly controlled.

The particle size distribution of toner particles can be measured using an apparatus for measuring the particle size distribution of toner particles by the Coulter principle.

Examples of such an apparatus include, but are not limited to, COULTER COUNTER TA II and COULTER MULTISIZER II (both available from Beckman Coulter Inc.).

A specific measurement method may be the same as the measurement method for the weight average particle diameter (D4) and the number average particle diameter (D1) of the invisible toner.

Method for Manufacturing Invisible Toner and Color Toner

The invisible toner and the color toner may be manufactured by conventionally known methods such as melt-kneading-pulverization methods and polymerization methods.

The invisible toner and the color toner may be manufactured by either the same method or different methods.

In the latter case, for example, the color toner may be manufactured by a polymerization method and the invisible toner may be manufactured by a melt-kneading-pulverization method.

Melt-Kneading-Pulverization Method

The melt-kneading-pulverization method preferably includes the following processes.

(1) A process of melt-kneading at least a binder resin and a near-infrared light absorbing material, optionally together with a release agent.

(2) A process of pulverizing/classifying the melt-kneaded toner composition.

(3) A process of externally adding fine inorganic particles.

It is preferable that fine powder produced in the pulverizing/classifying process (2) is reused as a raw material in the process (1) for saving cost.

With respect to the color toner, at least a binder resin and a colorant are melt-kneaded in the melt-kneading process (1).

Examples of kneaders used for the kneading include, but are not limited to, closed kneaders, single-screw or twin-screw extruders, and open-roll kneaders.

Specific examples of the kneaders include, but are not limited to, KRC KNEADER (available from Kurimoto, Ltd.); BUSS CO-KNEADER (available from Buss AG); TWIN SCREW COMPOUNDER TEM (available from Toshiba Machine Co., Ltd.); TWIN SCREW EXTRUDER TEX (available from The Japan Steel Works, Ltd.); TWIN SCREW EXTRUDER PCM (available from Ikegai Corp); THREE ROLL MILL, MIXING ROLL MILL, and KNEADER (available from Inoue Mfg., Inc.); KNEADEX (available from Nippon Coke & Engineering Company, Limited); MS TYPE DISPERSION MIXER and KNEADER-RUDER (available from Nihon Spindle Manufacturing Co., Ltd (formerly Moriyama Company Ltd.)), and BANBURY MIXER (available from Kobe Steel, Ltd.).

Specific examples of pulverizers include, but are not limited to, COUNTER JET MILL, MICRON JET, and INOMIZER (available from Hosokawa Micron Corporation); IDS-TYPE MILL and PJM JET MILL (available from Nippon Pneumatic Mfg. Co., Ltd.); CROSS JET MILL (available from Kurimoto, Ltd.); NSE-ULMAX (available from Nisso Engineering Co., Ltd.); SK JET-O-MILL (available from Seishin Enterprise Co., Ltd.); KRYPTRON (available from Kawasaki Heavy Industries, Ltd.); TURBO MILL (available from Freund-Turbo Corporation); and SUPER ROATER (available from Nisshin Engineering Inc.).

Specific examples of classifiers include, but are not limited to, CLASSIEL, MICRON CLASSIFIER, and SPEDIC CLASSIFIER (available from Seishin Enterprise Co., Ltd.); TURBO CLASSIFIER (available from Nisshin Engineering Inc.); MICRON SEPARATOR, TURBOPLEX ATP, and TSP SEPARATOR (available from Hosokawa Micron Corporation); ELBOW JET (available from Nittetsu Mining Co., Ltd.); DISPERSION SEPARATOR (available from Nippon Pneumatic Mfg. Co., Ltd.); and YM MICRO CUT (available from URAS TECHNO CO., LTD. (formerly Yaskawa & Co., Ltd.)).

Specific examples of sieving devices for sieving coarse particles include, but are not limited to, ULTRASONIC (available from Koei Sangyo Co., Ltd.); RESONASIEVE and GYRO-SIFTER (available from Tokuju Corporation); VIBRASONIC SYSTEM (available from DALTON CORPORATION); SONICLEAN (available from SINTOKOGIO, LTD.); TURBO SCREENER (available from FREUND-TURBO CORPORATION); MICRO SIFTER (available from MAKINO MFG. CO., LTD.); and circular vibration sieves.

Polymerization Method

Examples of the polymerization method include conventionally known methods. The polymerization method may be conducted by the following procedure.

First, the colorant, the binder resin, and the release agent are dispersed in an organic solvent to form a toner material liquid (or "oil phase"). Preferably, a polyester prepolymer (A) having an isocyanate group is added to the toner material liquid and allowed to react during granulation so as to form a urea-modified polyester resin in the toner.

Next, the toner material liquid is emulsified in an aqueous medium in the presence of a surfactant and fine resin particles.

The aqueous medium comprises an aqueous solvent. The aqueous solvent may comprise water alone or may further comprise an organic solvent such as an alcohol.

The used amount of the aqueous solvent is preferably from 50 to 2,000 parts by mass, more preferably from 100 to 1,000 parts by mass, with respect to 100 parts by mass of the toner material liquid.

The fine resin particles are not particularly limited and can be appropriately selected according to the purpose as long as they are capable of forming an aqueous dispersion thereof. Examples thereof include, but are not limited to, vinyl resins, polyurethane resins, epoxy resins, and polyester resins.

After the toner material liquid is emulsified (dispersed) in the aqueous medium, the emulsion (i.e., reactant) is subjected to removal of the organic solvent and subsequent washing and drying to obtain mother toner particles.

Developer

The invisible toner and the color toner each can be used as either a one-component developer or a two-component developer.

The two-component developer may be prepared by mixing the toner with a magnetic carrier. In the two-component developer, the amount of the toner in 100 parts by mass of the carrier is preferably from 1 to 10 parts by mass.

Examples of the magnetic carrier include conventionally known materials such as iron powder, ferrite powder, magnetite powder, and magnetic resin carriers.

Preferably, the magnetic carrier has a particle diameter of from 20 to 200 μm.

The magnetic carrier may be either uncoated or coated.

Specific examples of coating materials for coating the magnetic carrier include, but are not limited to, amino resins (e.g., urea-formaldehyde resin, melamine resin, benzoguanamine resin, urea resin, polyamide resin, epoxy resin), polyvinyl and polyvinylidene resins (e.g., acrylic resin, polymethyl methacrylate resin, polyacrylonitrile resin, polyvinyl acetate resin, polyvinyl alcohol resin, polyvinyl butyral resin), styrene resins (e.g., polystyrene resin, styrene-acrylic copolymer resin), halogenated olefin resins (e.g., polyvinyl chloride), polyester resins (e.g., polyethylene terephthalate resin, polybutylene terephthalate resin), polycarbonate resins, polyethylene resins, polyvinyl fluoride resins, polyvinylidene fluoride resins, poly(trifluoroethylene) resins, poly(hexafluoropropylene) resins, vinylidene fluoride-acrylic copolymer, vinylidene fluoride-vinyl fluoride copolymer, tetrafluoroethylene-vinylidene fluoride-non-fluoride monomer terpolymer, and silicone resins.

The coating material may contain a conductive powder, as necessary.

Specific examples of the conductive powder include, but are not limited to, metal powder, carbon black, titanium oxide, tin oxide, and zinc oxide.

The average particle diameter of the conductive powder is preferably 1 μm or less. When the average particle diameter is 1 μm or less, it will not be difficult to control electric resistance.

Recording Medium

The recording medium preferably contains at least lignin for maintaining invisibility of the invisible toner.

Lignin is reddish, and an image portion recorded with the invisible toner is also reddish. When the recording medium contains lignin, the hue of the invisible toner image portion become closer to that of the recording medium. Thus, invisibility of the invisible toner image is improved.

Toner Accommodating Unit

In the present disclosure, a toner accommodating unit refers to a unit having a function of accommodating toner and accommodating the toner. The toner accommodating unit may be in the form of, for example, a toner container, a developing device, or a process cartridge.

The toner container refers to a container containing the toner.

The developing device refers to a device containing the toner and having a developing unit configured to develop an electrostatic latent image into a toner image with the toner.

The process cartridge refers to a combined body of an image bearer with a developing unit containing the toner, detachably mountable on an image forming apparatus. The process cartridge may further include at least one of a charger, an irradiator, and a cleaner.

The toner accommodating unit accommodating the toner according to an embodiment of the present invention is mounted on an image forming apparatus to form a color image together with an invisible toner image on an image output medium. The invisible toner image provides invisibility and readability and the color toner image provides visibility, to the degree which cannot be realized by the conventional process of color image formation.

Image Forming Method and Image Forming Apparatus

An image forming method according to an embodiment of the present invention includes: an electrostatic latent image forming process in which an electrostatic latent image is formed on an electrostatic latent image bearer; a developing process in which the electrostatic latent image formed on the electrostatic latent image bearer is developed with an invisible toner to form an invisible toner image; a transfer process in which the invisible toner image formed on the electrostatic latent image bearer is transferred onto a surface of a recording medium; and a fixing process in which the invisible toner image is fixed on the surface of the recording medium. Preferably, the image forming method further includes a color toner image developing process in which the electrostatic latent image formed on the electrostatic latent image bearer is developed with a color toner comprising a binder resin and a colorant to form a color toner image. The image forming method may further include other processes, as necessary.

An image forming apparatus according to an embodiment of the present invention includes: an electrostatic latent image bearer: an electrostatic latent image forming device configured to form an electrostatic latent image on the electrostatic latent image bearer; a developing device containing an invisible toner, configured to develop the electrostatic latent image formed on the electrostatic latent image bearer with the invisible toner to form an invisible toner image; a transfer device configured to transfer the invisible toner image formed on the electrostatic latent image bearer onto a surface of a recording medium; and a fixing device configured to fix the invisible toner image on the surface of the recording medium. Preferably, the image forming apparatus further includes a color toner developing device containing a color toner, configured to develop the electrostatic latent image formed on the electrostatic latent image bearer with the color toner comprising a binder resin and a colorant to form a color toner image. The image forming apparatus may further include other devices, as necessary.

The image forming method according to an embodiment of the present invention can be suitably conducted by the image recording apparatus according to an embodiment of the present invention.

As the invisible toner, the invisible toner according to an embodiment of the present invention can be used.

As the color toner, the above-described color toner can be used.

On the recording medium, it is preferable that the invisible toner image is formed closer to the recording medium than the color toner image is.

The invisible toner image can be formed closer to the recording medium than the color toner image by, for example, forming the color toner image after the invisible toner image is formed on the recording medium.

The number of color toners used to form the color toner image is not particularly limited and can be appropriately selected according to the purpose.

In the case of using a plurality of color toners, the color toner image may be formed by either using the multiple color toners at the same time or repeatedly forming a single color toner image with each toner and superimposing the single color toner images. The latter is more preferable. In forming the color toner image, the order of forming each single color toner image is not particularly limited.

The deposition amount of the invisible toner is preferably from 0.30 to 0.45 mg/cm$^2$, more preferably from 0.35 to 0.40 mg/cm$^2$. When the deposition amount of the invisible toner is 0.30 mg/cm$^2$ or more, the rate of hiding of the substrate by the image is sufficient and a reliable image can be obtained.

Since the near-infrared light absorbing material has slight absorption in the visible light region and is not completely colorless, as the amount of the near-infrared absorbing material added to the toner increases, visibility is increased and invisibility is decreased. When the deposition amount of the invisible toner is 0.45 mg/cm$^2$ or less, visibility is decreased and invisibility is increased.

The ratio (area ratio) of the area of the color toner image to be placed on the invisible toner image to the area of the invisible toner image is preferably from 30% to 80%. When the area ratio is from 30% to 80%, visibility of the invisible toner image below the color toner image can be reduced and invisibility thereof can be improved.

The reason for this can be considered as follows.

The invisible toner has slight absorption in the visible light region, and therefore an image formed only of the invisible toner is not completely transparent. Therefore, to achieve the purpose of providing invisible image information, the invisible toner image needs to be masked with the color toner. When the area ratio of the color toner image is 30% or more, the invisible toner image is prevented from becoming easily visible. When the area ratio of the color toner image is 80% or less, an increase of visibility of the invisible toner image is prevented particularly when yellow toner is superimposed thereon.

An image forming method which makes the area ratio of the color toner image on the invisible toner image to be from 30% to 80% is effective particularly for forming an image by superimposing two-dimensional code images. In a case in which an image is formed by superimposing a two-dimensional code image formed with the invisible toner and another two-dimensional code image formed with the color toner, each containing different information, and is respectively read by reading devices of different light wavelengths (860 nm and 532 nm), it is possible to read multiple types of information from the same position and acquire a larger amount of information.

On the recording medium, it is preferable that a two-dimensional code image (i) as the invisible toner image is formed closer to the recording medium than another two-dimensional code image (c) as the color toner image is.

In this case, when the color toner image is a solid image, the absorbance of the solid image at from 800 to 900 nm is preferably less than 0.05, more preferably less than 0.01.

Also, it is preferable that the two-dimensional code image (i) and the two-dimensional code image (c) contain different information.

In a case in which a two-dimensional code image formed of the invisible toner and another two-dimensional code image formed of the color toner are superimposed, the two-dimensional code image formed of the color toner may be a dummy code. In such a case, the two-dimensional code image formed of the invisible toner cannot be visually recognized and information thereof can only be read by a two-dimensional code reader of infrared light. The two-dimensional code image formed of the color toner can be visually recognized but information thereof cannot be read by the two-dimensional code reader of infrared light.

Electrostatic Latent Image Forming Process and Electrostatic Latent Image Forming Device The electrostatic latent image forming process is a process in which an electrostatic latent image is formed on an electrostatic latent image bearer.

The formation of the electrostatic latent image can be conducted by, for example, uniformly charging a surface of the electrostatic latent image bearer and irradiating the surface with light containing image information by the electrostatic latent image forming device.

The electrostatic latent image forming device may include at least a charger to uniformly charge a surface of the electrostatic latent image bearer and an irradiator to irradiate the surface of the electrostatic latent image bearer with light containing image information.

The electrostatic latent image bearer (hereinafter may be referred to as "electrophotographic photoconductor", "photoconductor", or "image bearer") is not limited in material, shape, structure, and size, and can be appropriately selected from known materials.

The shape of the image bearer may be, for example, a drum-like shape or a belt-like shape. The material of the image bearer may comprise, for example, inorganic photoconductors such as amorphous silicon and selenium, and organic photoconductors (OPC) such as polysilane and phthalopolymethine.

The charging can be conducted by, for example, applying a voltage to a surface of the electrostatic latent image bearer by the charger.

Specific examples of the charger include, but are not limited to, contact chargers equipped with a conductive or semiconductive roller, brush, film, or rubber blade and non-contact chargers employing corona discharge such as corotron and scorotron.

Preferably, the charger is disposed in or out of contact with the electrostatic latent image bearer, and configured to charge the surface of the electrostatic latent image bearer by applying a direct-current voltage and an alternating-current voltage in superposition thereto.

Preferably, the charger is a charging roller disposed close to but out of contact with the electrostatic latent image bearer via a gap tape, and configured to charge the surface of the electrostatic latent image bearer by applying a direct-current voltage and an alternating-current voltage in superposition thereto.

The irradiation can be conducted by, for example, irradiating the surface of the electrostatic latent image bearer with light containing image information by the irradiator.

The irradiator is not particularly limited and can be appropriately selected according to the purpose as long as it is capable of irradiating the surface of the electrostatic latent image bearer charged by the charger with light containing image information. Specific examples of the irradiator include, but are not limited to, various irradiators of radiation optical system type, rod lens array type, laser optical type, and liquid crystal shutter optical type.

The irradiation can also be conducted by irradiating the back surface of the electrostatic latent image bearer with light containing image information.

Developing Process and Developing Device

The developing process is a process in which the electrostatic latent image is developed into a toner image with the toner.

The formation of the toner image can be conducted by, for example, developing the electrostatic latent image with the toner by the developing device.

Preferably, the developing device includes developing units storing respective toners of the toner set, each configured to apply the toner to the electrostatic latent image by contacting or without contacting the electrostatic latent image. More preferably, each developing unit is equipped with a container containing the toner.

The developing unit may be either a monochrome developing unit or a multicolor developing unit. Preferably, the developing unit includes a stirrer that frictionally stirs and charges the toner of the toner set (hereinafter simply "toner") and a rotatable magnet roller.

In the developing unit, toner particles and carrier particles are mixed and stirred. The toner particles are charged by friction and retained on the surface of the rotating magnet roller, thus forming magnetic brush. The magnet roller is disposed proximity to the electrostatic latent image bearer (photoconductor), so that a part of the toner particles composing the magnetic brush formed on the surface of the magnet roller are moved to the surface of the electrostatic latent image bearer (photoconductor) by electric attractive force. As a result, the electrostatic latent image is developed with the toner particles and a toner image is formed with the toner particles on the surface of the electrostatic latent image bearer (photoconductor).

The developing process is a process in which the electrostatic latent image formed on the electrostatic latent image bearer is developed into a toner image that includes an invisible toner image and a color toner image. Preferably, the invisible toner image is formed with the invisible toner, and the color toner image is formed with the color toner containing a binder resin and a colorant.

Preferably, the developing device stores the invisible toner and the color toner to develop the electrostatic latent image formed on the electrostatic latent image bearer into a toner image that includes an invisible toner image and a color toner image. Specifically, the invisible toner image is formed with the invisible toner, and the color toner image is formed with the color toner containing a binder resin and a colorant.

The toner image includes the invisible toner image formed with the invisible toner and the color toner image formed with the color toner.

The colors constituting the color toner may include, for example, a set of four colors including black (Bk), cyan (C), magenta (M), and yellow (Y), a set of three colors including cyan (C), magenta (M), and yellow (Y), or a single color of black (Bk). Among these, the set of four colors is preferable. It can be mounted on a general electrophotographic image forming apparatus using four color toners.

Fixing Process and Fixing Device

The fixing process is a process in which an image transferred onto the recording medium is fixed thereon. The fixing process may be conducted every time each color developer is transferred onto the recording medium. Alternatively, the fixing process may be conducted at once after all color developers are superimposed on one another on the recording medium.

The fixing device is not particularly limited and can be appropriately selected according to the purpose as long as it is capable of fixing the transferred image on the recording medium. Preferred examples of the fixing device includes a heat-pressure member. Specific examples of the heat-pressure member include, but are not limited to, a combination of a heat roller and a pressure roller; and a combination of a heat roller, a pressure roller, and an endless belt.

Preferably, the fixing device includes a heater equipped with a heat generator, a film in contact with the heater, and a pressurizer pressed against the heater via the film, and is configured to allow a recording medium having an unfixed image thereon to pass through between the film and the pressurizer, so that the unfixed image is fixed on the recording medium by application of heat. The heating temperature of the heat-pressure member is preferably from 80 to 200 degrees C.

The fixing device may be used together with or replaced with an optical fixer according to the purpose.

Other Processes and Other Devices

The other processes may include, for example, a neutralization process, a cleaning process, a recycle process, and a control process.

The other devices may include, for example, a neutralizer, a cleaner, a recycler, and a controller.

The neutralization process is a process in which a neutralization bias is applied to the electrostatic latent image bearer to neutralize the electrostatic latent image bearer, and is preferably conducted by a neutralizer.

The neutralizer is not particularly limited and can be appropriately selected from known neutralizer as long as it is capable of applying a neutralization bias to the electrostatic latent image bearer. Specific examples of the neutralizer include, but are not limited to, a neutralization lamp.

The cleaning process is a process in which residual toner particles remaining on the electrostatic latent image bearer are removed, and is preferably conducted by a cleaner.

The cleaner is not particularly limited and can be appropriately selected from known cleaners as long as it is capable of removing residual toner particles remaining on the electrostatic latent image bearer. Specific examples of the cleaner include, but are not limited to, a magnetic brush cleaner, an electrostatic brush cleaner, a magnetic roller cleaner, a blade cleaner, a brush cleaner, and a web cleaner.

The recycle process is a process in which the toner particles removed in the cleaning process are recycled for the developing device, and is preferably conducted by a recycler. The recycler is not particularly limited. Specific examples of the recycler include, but are not limited to, a conveyor.

The control process is a process in which the above-described processes are controlled, and is preferably conducted by a controller.

The controller is not particularly limited as long as it is capable of controlling the above-described processes. Specific examples of the controller include, but are not limited to, a sequencer and a computer.

Details of the image forming method and the image forming apparatus are described below with reference to the drawings.

Figure 3:
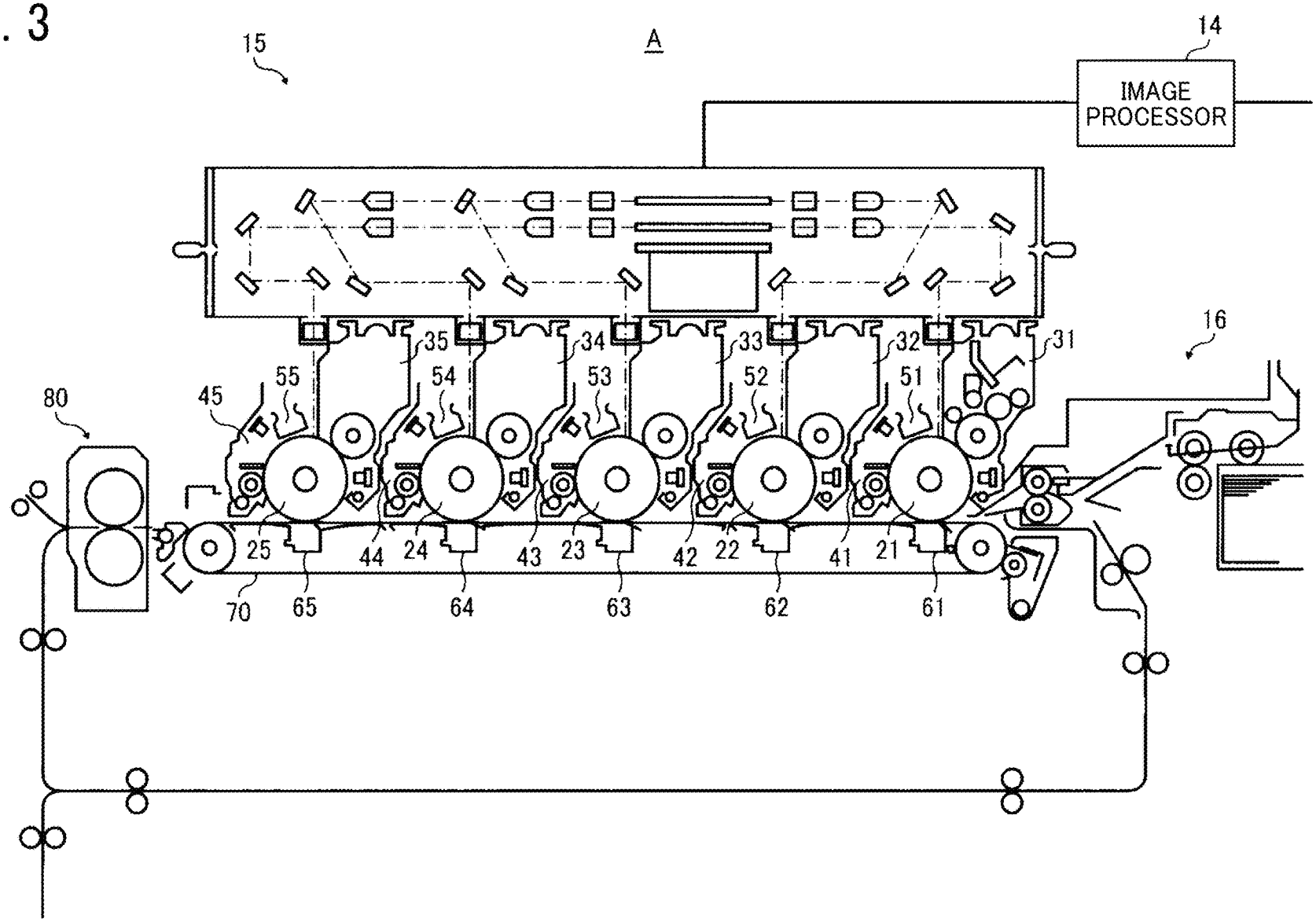
FIG. 3 is a schematic view of an image forming apparatus according to an embodiment of the present invention.

FIG. 3 is a schematic diagram illustrating an image forming apparatus A according to an embodiment of the present invention. Image data sent to an image processor 14 generates image signals of five colors including Iv (invisible), Y (yellow), M (magenta), C (cyan), and Bk (black).

Next, the image processor 14 transmits the image signals of Iv, Y, M, C, and Bk to a writing device 15. The writing device 15 modulates five laser beams corresponding to Iv, Y, M, C, and Bk image signals and scans respective photoconductor drums 21, 22, 23, 24, and 25 having been charged by respective chargers 51, 52, 53, 54, and 55, thus sequentially forming respective electrostatic latent images thereon. Here, as an example, the first photoconductor drum 21 corresponds to Iv, the second photoconductor drum 22 corresponds to Y, the third photoconductor drum 23 corresponds to M, the fourth photoconductor drum 24 corresponds to C, and the fifth photoconductor drum 25 corresponds to Bk.

Next, developing units 31, 32, 33, 34, and 35, serving as the developing device, form toner images of respective colors on the respective photoconductor drums 21, 22, 23, 24, and 25. A sheet feeder 16 feeds a transfer sheet onto a transfer belt 70. Transfer chargers 61, 62, 63, 64, and 65 sequentially transfer each toner image onto the respective photoconductor drums 21, 22, 23, 24, and 25.

After completion of the transfer process, the transfer sheet is conveyed to a fixing device 80. The fixing device 80 fixes the transferred toner image on the transfer sheet.

After completion of the transfer process, residual toner particles remaining on the photoconductor drums 21, 22, 23, 24, and 25 are removed by respective cleaners 41, 42, 43, 44, and 45.

Figure 4:
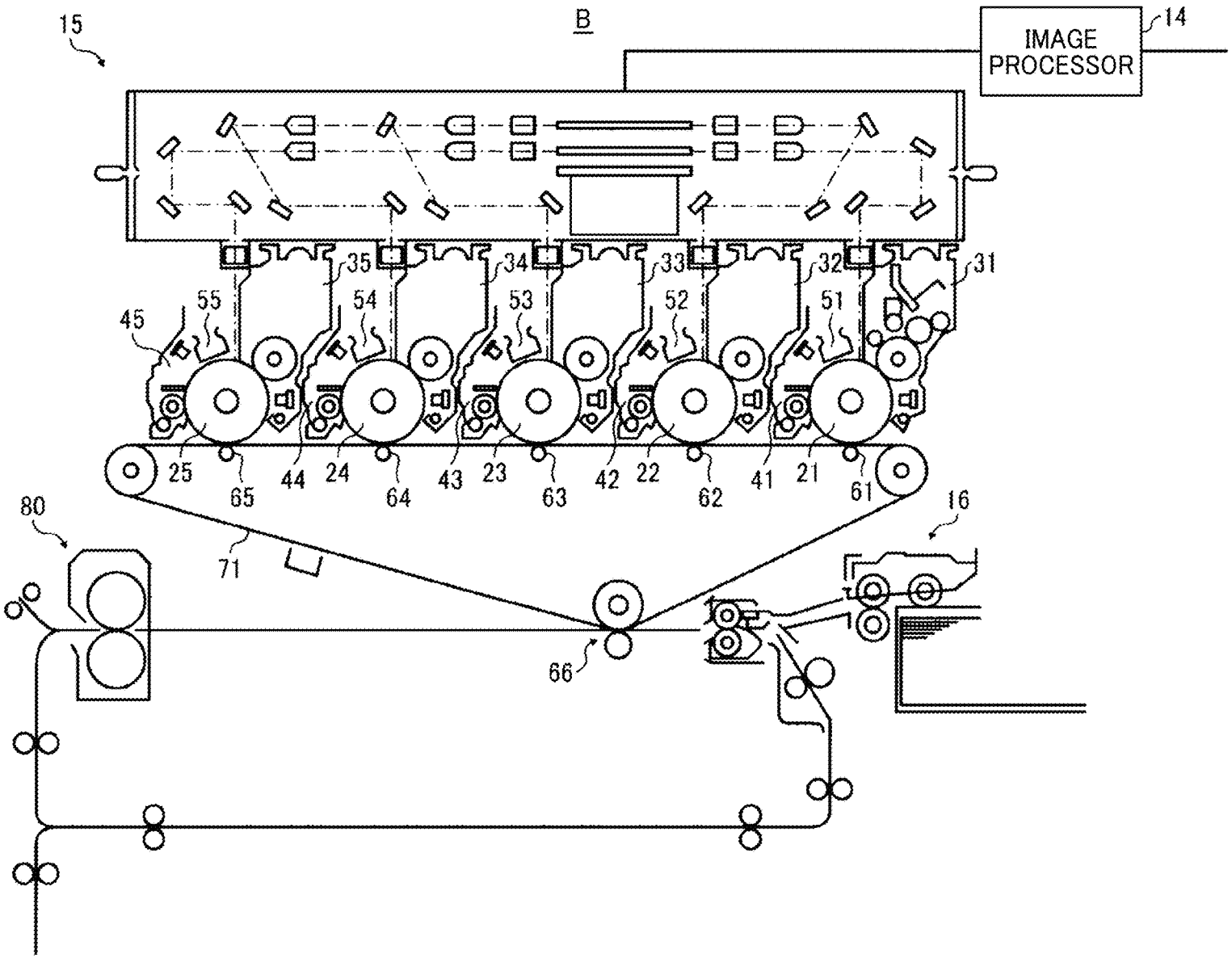
FIG. 4 is a schematic view of an image forming apparatus according to an embodiment of the present invention.
Figure 5:
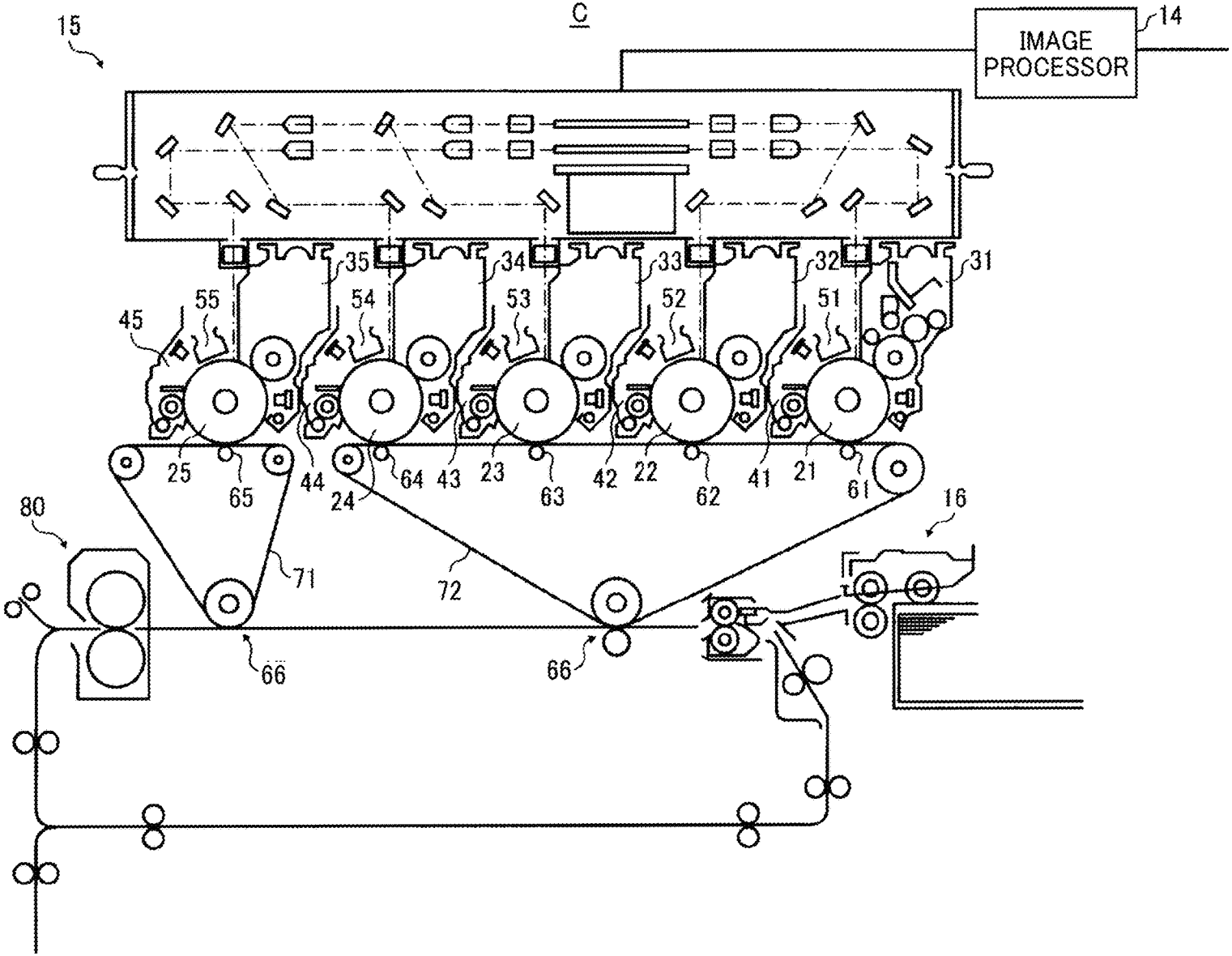
FIG. 5 is a schematic view of an image forming apparatus according to an embodiment of the present invention.

In an image forming apparatus B illustrated in FIG. 4, toner images are formed on the photoconductor drums 21, 22, 23, 24, and 25 in the same manner as in FIG. 3, then temporarily transferred onto an intermediate transfer belt 71, further transferred onto a transfer sheet by a secondary transfer device 66, and fixed on the transfer sheet by the fixing device 80. When the invisible toner is formed into a thick layer on the intermediate transfer belt 71, the thick layer of the invisible toner is more difficult to secondarily transfer. Therefore, a separate intermediate transfer medium 72 may be provided as in an image forming apparatus C illustrated in FIG. 5.

Next, the peripheral configuration of the developing unit is described below.

Figure 6:
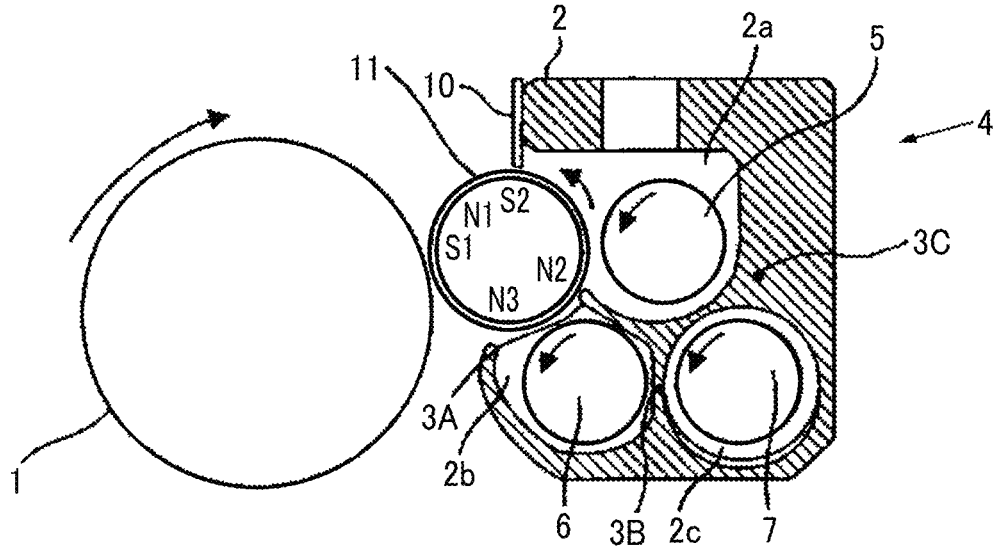
FIG. 6 is a cross-sectional view of a developing device in an image forming apparatus according to an embodiment of the present invention.

FIG. 6 is a schematic view illustrating a developing unit 4 and a photoconductor drum 1. The developing unit 4 represents one of the developing units 31, 32, 33, 34, and 35 each having almost the same configuration except for handling different color toners. The photoconductor drum 1 represents one of the photoconductor drums 21, 22, 23, 24, and 25 each having almost the same configuration except for handling different color toners.

The developing unit 4 includes a developer container 2 containing a two-component developer. A developing sleeve 11 as a developer bearer is rotatably disposed at an opening of the developer container 2 facing the photoconductor drum 1 (hereinafter simply "photoconductor 1") with a predetermined distance from the photoconductor 1. The developing sleeve 11 is formed of a cylinder made of a non-magnetic material. The developing sleeve 11 rotates such that the developing sleeve 11 moves in the same direction as the photoconductor 1 that rotates in the direction indicated by arrow in FIG. 6, at a portion where they are facing each other. Inside the developing sleeve 11, a magnet roller as a magnetic field generator is fixedly disposed. The magnet roller has five magnetic poles N1, S1, N2, N3, and S2. A regulation blade 10 as a developer regulator is attached to a portion of the developer container 2 above the developing sleeve 11. The regulation blade 10 is disposed out of contact with the developing sleeve 11 toward the vicinity of the magnetic pole S2 that is approximately positioned at the uppermost point of the magnet roller in the vertical direction.

In the developer container 2, a supplying conveyance path 2*a*, a collecting conveyance path 2*b*, and a stirring conveyance path 2*c* are disposed. The supplying conveyance path 2*a* accommodates a supplying screw 5 as a first developer stirring conveyer. The collecting conveyance path 2*b* accommodates a collecting screw 6 as a second developer stirring conveyer. The stirring conveyance path 2*c* accommodates a stirring screw 7 as a third developer stirring conveyer. The supplying conveyance path 2*a* and the stirring conveyance path 2*c* are disposed obliquely in the vertical direction. The collecting conveyance path 2*b* is disposed substantially horizontal to the stirring conveyance path 2*c* on the downstream side of the developing region of the developing sleeve 11.

The two-component developer contained in the developer container 2 is stirred and conveyed by the supplying screw 5, the collecting screw 6, and the stirring screw 7 within the supplying conveyance path 2*a*, the collecting conveyance path 2*b*, and the stirring conveyance path 2*c* and supplied to the developing sleeve 11 from the supplying conveyance path 2*a*. The developer supplied to the developing sleeve 11 is drawn up onto the developing sleeve 11 by the magnetic pole N2 of the magnet roller. As the developing sleeve 11 rotates, the developer is conveyed from the magnetic pole S2 to the magnetic pole S1 via the magnetic pole N1 on the developing sleeve 11. Thus, the developer reaches the developing region where the developing sleeve 11 and the photoconductor 1 are facing. During the conveyance of the developer, the regulation blade 10 magnetically regulates the layer thickness of the developer in cooperation with the magnetic pole S2. As a result, a thin layer of the developer is formed on the developing sleeve 11. The magnetic pole S1 of the magnet roller, positioned in the developing region of the developing sleeve 11, is the main developing pole. The developer conveyed to the developing region is formed into a magnetic brush by the magnetic pole S1 and brought into contact with the surface of the photoconductor 1, thereby developing the electrostatic latent image formed on the surface of the photoconductor 1.

The developer having been used for developing the electrostatic latent image is returned to the developer container 2 via the developing region and the transport pole N3 as the developing sleeve 11 rotates. The developer is then separated from the developing sleeve 11 by the repulsive magnetic fields of the magnetic poles N2 and N3 and collected into the collecting conveyance path 2*b* by the collecting screw 6.

The supplying conveyance path 2*a* and the collecting conveyance path 2*b* disposed obliquely below the supplying conveyance path 2*a* are separated by the a first partition 3A.

Figure 7:
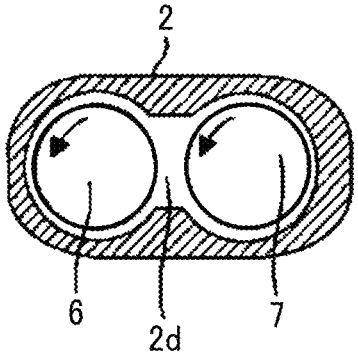
FIG. 7 is a cross-sectional view of a collecting conveyance path and a stirring conveyance path in an image forming apparatus according to an embodiment of the present invention, at a downstream portion of the collecting conveyance path with respect to the direction of conveyance of developer.

The collecting conveyance path 2*b* and the stirring conveyance path 2*c* disposed laterally to each other are separated by a second partition 3B. The second partition 3B has an opening for supplying the developer collected into the collecting conveyance path 2*b* to the stirring conveyance path 2*c* on a downstream portion thereof with respect to the direction of conveyance of developer by the collecting screw 6 in the collecting conveyance path 2*b*. FIG. 7 is a cross-sectional view of the collecting conveyance path 2*b* and the stirring conveyance path 2*c* at a downstream portion with respect to the direction of conveyance of developer by the collecting screw 6. An opening 2*d* communicating the collecting conveyance path 2*b* and the stirring conveyance path 2*c* is provided.

The supplying conveyance path 2*a* and the stirring conveyance path 2*c* disposed obliquely below the supplying conveyance path 2*a* are separated by a third partition 3C. The third partition 3C has respective openings for supplying the developer on an upstream portion and a downstream portion thereof with respect to the direction of conveyance of developer by the supplying screw 5 in the supplying conveyance path 2*a*.

Figure 8:
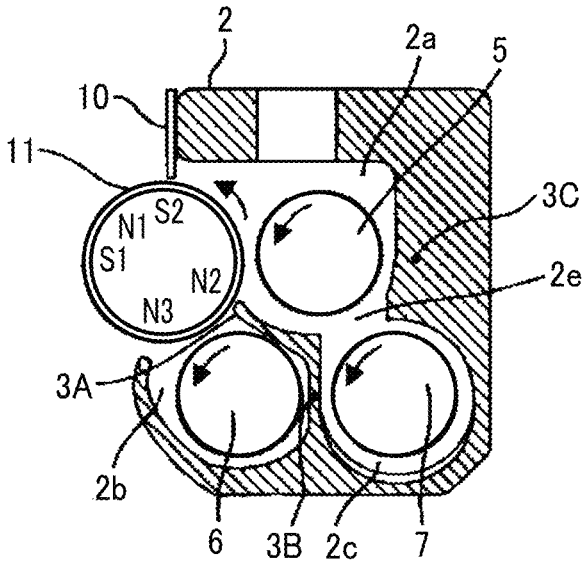
FIG. 8 is a cross-sectional view of an image forming apparatus according to an embodiment of the present invention, at an upstream portion of a supplying conveyance path with respect to the direction of conveyance of developer.

FIG. 8 is a cross-sectional view of the developing unit 4 at an upstream portion with respect to the direction of conveyance of developer by the supplying screw 5. The third partition 3C has an opening 2*e* communicating the stirring conveyance path 2*c* and the supplying conveyance path 2*a*.

Figure 9:
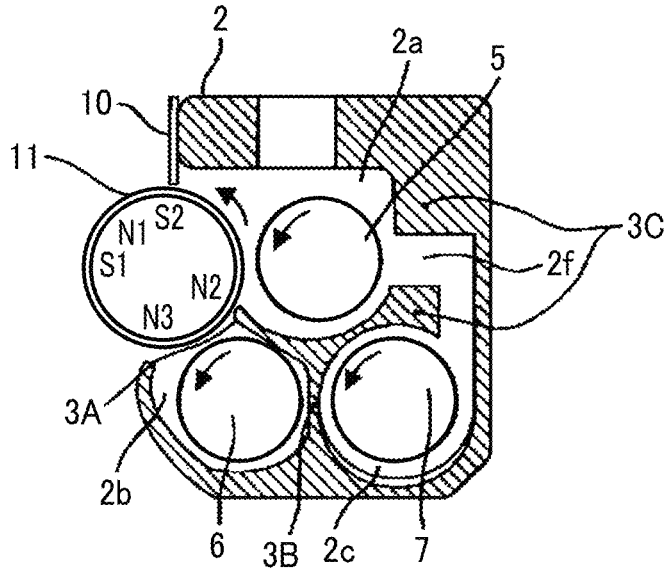
FIG. 9 is a cross-sectional view of an image forming apparatus according to an embodiment of the present invention, at a downstream portion of a supplying conveyance path with respect to the direction of conveyance of developer.

FIG. 9 is a cross-sectional view of the developing unit 4 at a downstream portion with respect to the direction of conveyance of developer by the supplying screw 5. The third partition 3C has an opening 2*f* communicating the stirring conveyance path 2*c* and the supplying conveyance path 2*a*.

Next, circulation of the developer in the three developer conveyance paths is described below.

Figure 10:
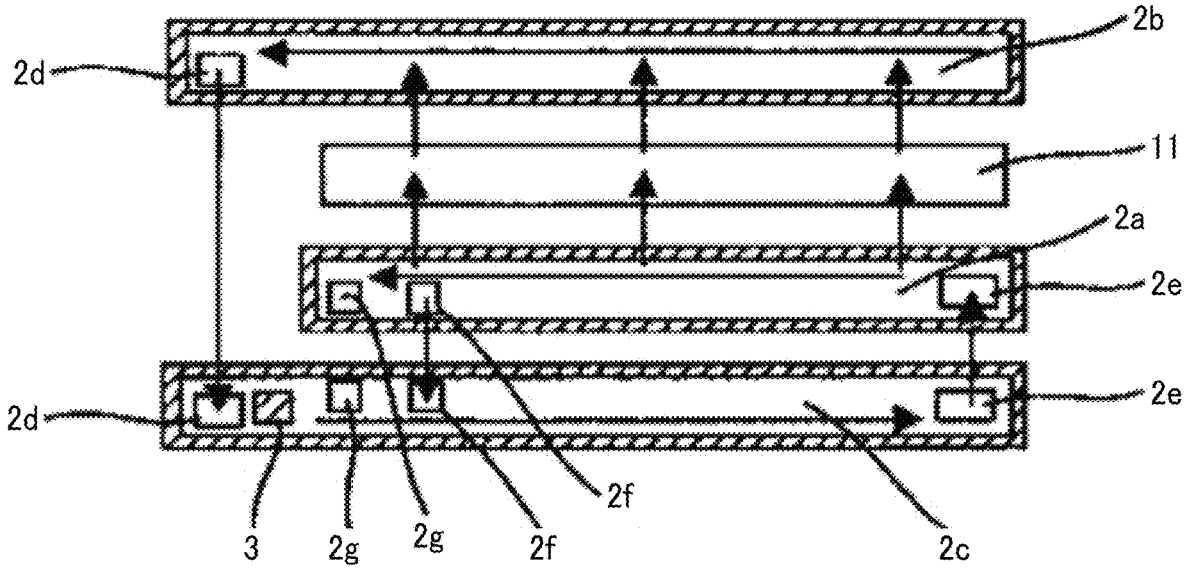
FIG. 10 is a schematic diagram illustrating the flow of developer in the developing device.

FIG. 10 is a schematic diagram illustrating the flow of the developer in the developing unit 4. Each arrow in FIG. 10 indicates the direction of movement of the developer. In the supplying conveyance path 2*a*, the developer supplied from the stirring conveyance path 2*c* is conveyed downstream with respect to the direction of conveyance of developer by the supplying screw 5 while the developer is supplied to the developing sleeve 11. An excess developer having been conveyed to a downstream portion in the supplying conveyance path 2*a* with respect to the direction of conveyance of developer without being supplied to the developing sleeve 11 is supplied to the stirring conveyance path 2*c* through the opening 2*f* as the first developer supply opening provided on the third partition 3C.

The developer having been collected from the developing sleeve 11 into the collecting conveyance path 2*b* by the collecting screw 6 is conveyed to a downstream potion in the collecting conveyance path 2*b*, in the same direction as the direction of conveyance of developer in the supplying conveyance path 2*a*. The developer is then supplied to the stirring conveyance path 2*c* through the opening 2*d* as the second developer supply opening provided on the second partition 3B.

The excess developer and the collected developer having been supplied to the stirring conveyance path 2*c* are stirred by the stirring screw 7 and conveyed in the direction opposite to the direction of conveyance of the developer in the collecting conveyance path 2*b* and the supplying conveyance path 2*a*. The developer having been conveyed to a downstream portion in the stirring conveyance path 2*c* with respect to the direction of conveyance of developer is supplied to an upstream portion in the supplying conveyance path 2*a* with respect to the direction of conveyance of developer through the opening 2*e* as the third developer supply opening provided on the third partition 3C.

A toner concentration sensor is disposed below the stirring conveyance path 2*c*. The toner concentration sensor operates a toner supply controller to supply toner from a toner container. In the stirring conveyance path 2*c*, a toner supplied through a toner supply opening 3, as needed, is conveyed by the stirring screw 7 downstream with respect to the direction of conveyance of developer while being stirred with the collected developer and the excess developer. It is preferable that the toner is supplied upstream of the stirring screw 7 for extending the stirring time from the supply to the development.

The developing unit 4 includes the supplying conveyance path 2*a* and the collecting conveyance path 2*b*, so that supply and collection of the developer are performed in separated developer conveyance paths. Therefore, the developer having been used for the development is prevented from coming into the supplying conveyance path 2*a*. Thus, a decrease of the toner concentration in the developer supplied to the developing sleeve 11 is more prevented at the more downstream side in the supplying conveyance path 2*a* with respect to the direction of conveyance of developer. In addition, since the collecting conveyance path 2*b* and the stirring conveyance path 2*c* are provided to perform collection and stirring of the developer in separated developer conveyance paths, the developer having been used for the development is prevented from falling during the stirring. Therefore, the developer having been sufficiently stirred is supplied to the supplying conveyance path 2*a*. Insufficient stirring of the developer to be supplied to the supplying conveyance path 2*a* is prevented.

Thus, both a decrease of the toner concentration in the developer in the supplying conveyance path 2*a* and insufficient stirring of the developer in the supplying conveyance path 2*a* are prevented, thereby making the image density constant during the development.

At an upstream portion in the supplying conveyance path 2*a* with respect to the direction of conveyance of developer, as illustrated in FIG. 8, the developer is supplied from the stirring conveyance path 2*c*, disposed obliquely below the supplying conveyance path 2*a*, to the supplying conveyance path 2*a*. Specifically, the stirring screw 7 rotates to push the developer into the opening 2*e* to cause the developer to overflow from the opening 2*e*, thereby supplying the developer to the supplying conveyance path 2*a*. Such a movement of the developer gives stress to the developer and reduces the lifespan of the developer.

In the developing unit 4, the supplying conveyance path 2*a* is disposed obliquely above the stirring conveyance path 2*c*. This configuration makes it possible to reduce stress given to the developer during movement of the developer upward as compared with a case in which the supplying conveyance path 2*a* is disposed vertically above the stirring conveyance path 2*c*.

Figure 11:
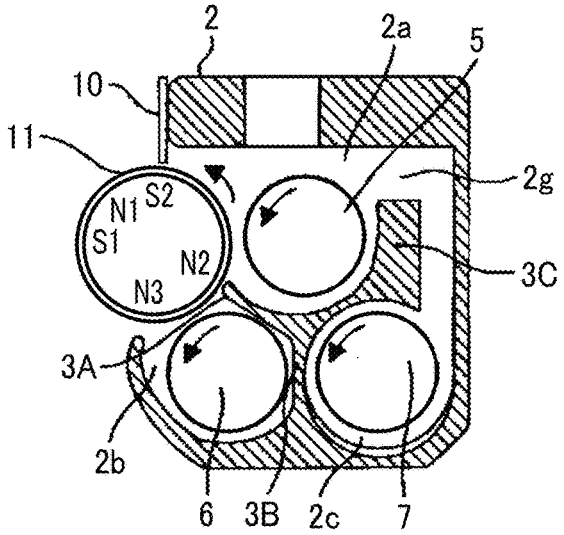
FIG. 11 is a cross-sectional view of the developing device, at the most downstream portion of the supplying conveyance path with respect to the direction of conveyance of developer.

At a downstream portion with respect to the direction of conveyance of developer by the supplying screw 5, as illustrated in FIG. 9, the opening 2*f* communicating the supplying conveyance path 2*a* and the stirring conveyance path 2*c* is provided for supplying the developer from the supplying conveyance path 2*a* to the stirring conveyance path 2*c* disposed obliquely below the supplying conveyance path 2*a*. The third partition 3C separating the stirring conveyance path 2*c* and the supplying conveyance path 2*a* extends upward from the lowest point of the supplying conveyance path 2*a*. The opening 2*f* is positioned above the lowest point. FIG. 11 is a cross-sectional view of the developing unit 4 at the most downstream portion with respect to the direction of conveyance of developer by the supplying screw 5. As illustrated in FIG. 11, the third partition 3C has an opening 2*g* communicating the stirring conveyance path 2*c* and the supplying conveyance path 2*a* on a downstream portion from the opening 2*f* with respect to the direction of conveyance of developer by the supplying screw 5. The opening 2*g* is positioned above the uppermost part of the opening 2*f*.

In the supplying conveyance path 2*a* having the openings 2*f* and 2*g*, the developer is conveyed in the axial direction of the supplying conveyance path 2*a* toward the opening 2*f* by the supplying screw 5. The developer having reached the lowermost part of the opening 2*f* falls into the stirring conveyance path 2*c* disposed therebelow through the opening 2*f*. By contrast, the developer failed to reach the lowermost part of the opening 2*f* is supplied to the developing sleeve 11 while being conveyed further downstream by the supplying screw 5. Therefore, on the downstream side of the opening 2*f* in the supplying conveyance path 2*a*, the bulk of the developer gradually becomes lower than the lowermost part of the opening 2*f*. The bulk of the developer may be high at the most downstream end, since the most downstream end of the supplying conveyance path 2*a* is a dead end. However, when the bulk comes to have a certain height, the developer is pushed back against rotation of the supplying screw 5 and returned to the opening 2*f*. The developer having reached the lowermost part of the opening 2*f* falls into the stirring conveyance path 2*c* disposed therebelow through the opening 2*f*. Therefore, on the downstream side of the opening 2*f* in the supplying conveyance path 2*a*, the bulk of the developer is not kept increasing but kept in an equilibrium state with a gradient near the lowermost part of the opening 2*f*. When the opening 2*g* is disposed higher than the uppermost part of the opening 2*f*, in other words, disposed higher than the position of the equilibrium state, there is little possibility that the opening 2*f* is clogged with the developer and ventilation becomes insufficient. Thus, sufficient ventilation can be secured between the stirring conveyance path 2*c* and the supplying conveyance path 2*a*. The opening 2*g* has a function of ensuring sufficient ventilation between the supplying conveyance path 2*a* and the stirring conveyance path 2*c* rather than a function of supplying developer between the supplying conveyance path 2*a* and the stirring conveyance path 2*c*. By providing the opening 2*g* for ventilation, even when the internal pressure rises in the stirring conveyance path 2*c* and the collecting conveyance path 2*b* communicating with the stirring conveyance path 2*c* each disposed on a lower side, sufficient ventilation is secured between them and the supplying conveyance path 2*a* disposed on an upper side and equipped with a filter for passing air, thereby preventing an increase of the internal pressure of the entire developing unit 4.

The toner set according to an embodiment of the present invention may be contained in a process cartridge detachably mountable on an image forming apparatus body that integrally supports a photoconductor and at least one of an electrostatic latent image forming device, a developing device, and a cleaner.

Figure 12:
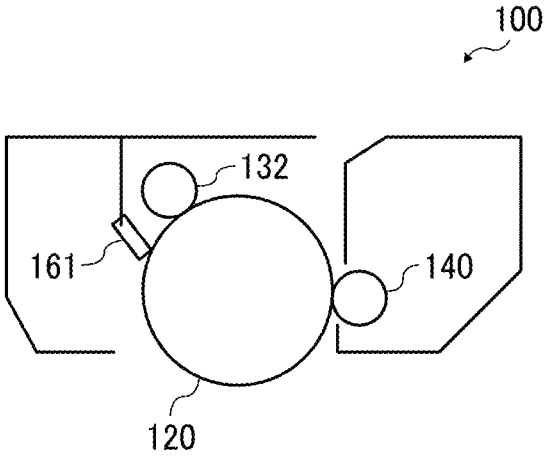
FIG. 12 is a schematic view of a process cartridge according to an embodiment of the present invention.

FIG. 12 is a schematic view of a process cartridge 100 according to an embodiment of the present invention that contains the toner according to an embodiment of the present invention.

Referring to FIG. 12, the process cartridge 100 includes a photoconductor 120, an electrostatic latent image forming device 132, a developing device 140, and a cleaner 161.

In the present embodiment, multiple constituent elements including the photoconductor 120, the electrostatic latent image forming device 132, the developing device 140, and the cleaner 161 are integrally combined to provide the process cartridge 100. The process cartridge 100 is configured to be detachably attachable to an image forming apparatus main body such as a copier and a printer.

The operation of the image forming apparatus equipped the process cartridge containing the toner according to an embodiment of the present invention is described below.

The photoconductor is driven to rotate at a predetermined circumferential speed. During rotation of the photoconductor, a circumferential surface of the photoconductor is uniformly charged to a predetermined positive or negative potential by the electrostatic latent image forming device, and then irradiated with light emitted from an irradiator by slit exposure or laser beam scanning exposure, so that electrostatic latent images are sequentially formed on the circumferential surface of the photoconductor. The electrostatic latent images thus formed are subsequently developed into toner images by the developing device. The toner images are sequentially transferred onto a transfer material fed from a sheet feeder to between the photoconductor and the transfer device in synchronization with rotation of the photoconductor. The transfer material having the transferred image thereon is separated from the surface of the photoconductor and introduced to the fixing device so that the image is fixed. The transfer material having the fixed image thereon is printed out the apparatus as a copy. After the image transfer, the surface of the photoconductor is cleaned by removing residual toner particles by the cleaner and further neutralized to be repeatedly used for image formation.

EXAMPLES

Further understanding can be obtained by reference to certain specific examples which are provided herein for the purpose of illustration only and are not intended to be limiting. In the following descriptions, "parts" represents parts by mass and "% (percent)" represents percent by mass unless otherwise specified.

The weight average molecular weight Mw and the ½ outflow temperature $T_{F1/2}$ were measured as follows.

Weight Average Molecular Weight Mw

The weight average molecular weight Mw of each invisible toner was determined by measuring a molecular weight distribution of tetrahydrofuran (THF)-soluble matter in the toner by a gel permeation chromatography (GPC) measuring instrument (GPC-150C available from Waters Corporation).

First, columns (SHODEX KF801-807 available from Showa Denko K.K.) were stabilized in a heat chamber at 40 degrees C., and THF as a solvent was let to flow at a flow rate of 1 mL/min. Next, 0.05 g of a sample (invisible toner) was thoroughly dissolved in 5 g of THF and thereafter filtered with a pretreatment filter (CHROMATODISC available from KURABO INDUSTRIES LTD., having a pore diameter of 0.45 μm), so that a THF solution of the sample having a sample concentration of from 0.05% to 0.6% by mass was prepared. The THF solution of the sample thus prepared in an amount of from 50 to 200 μL was injected in the measuring instrument.

The weight average molecular weight Mw and the number average molecular weight Mn of THF-soluble matter in the invisible toner were determined by comparing the molecular weight distribution of the invisible toner with the calibration curve created with several types of monodisperse polystyrene standard samples that shows the relation between the logarithmic values of molecular weights and the number of counts.

Ten polystyrene standard samples having respective molecular weights of $6\times10^2$, $2.1\times10^2$, $4\times10^2$, $1.75\times10^4$, $5.1\times10^4$, $1.1\times10^5$, $3.9\times10^5$, $8.6\times10^5$, $2\times10^6$, and $4.48\times10^6$ (available from Pressure Chemical Company or Tosoh Corporation) were used to create the calibration curve. As the detector, a refractive index (RI) detector was used.

½ Outflow Temperature $T_{F1/2}$

Using a flowtester (CFT-500D available from Shimadzu Corporation), 1 g of a sample was applied with a load of 1.96 MPa by a plunger while being heated at a temperature rising rate of 6 degrees C./min and extruded from a nozzle having a diameter of 1 mm and a length of 1 mm. The amount of drop of the plunger of the flowtester was plotted against the temperature, and the temperature at which the half of the sample had flowed out was taken as the ½ outflow temperature $T_{F1/2}$.

Example 1

Preparation Example 1 of Invisible Toner

Toner raw materials, including 15.8 parts by mass of a polyester resin (RN-290 available from Kao Corporation), 78.9 parts by mass of a polyester resin (RN-306 available from Kao Corporation), 5.3 parts by mass of a synthetic ester wax (WEP-5 available from NOF CORPORATION), and 0.5 parts by mass of a squarylium dye having the following structural formula (1) as a near-infrared light absorbing material, were preliminary mixed by a HENSCHEL MIXER (FM20B available from NIPPON COKE & ENGINEERING CO., LTD.) and then melt-kneaded by a single-shaft kneader (BUSS CO-KNEADER available from Buss AG) at a temperature of from 100 to 130 degrees C. The kneaded product was cooled to room temperature and pulverized into coarse particles having a diameter of from 200 to 300 μm by a ROTOPLEX. The coarse particles were further pulverized into fine particles having a weight average particle diameter (D4) of 6.2±0.3 μm by a COUNTER JET MILL (100AFG available from Hosokawa Micron Corporation) while appropriately adjusting the pulverization air pressure. The fine particles were classified by size using an air classifier (EJ-LABO available from MATSUBO Corporation) while appropriately adjusting the opening of the louver such that the weight average particle diameter (D4) became 7.0±0.2 μm and the ratio (D4/D1) of weight average particle diameter (D4) to number average particle diameter (D1) became 1.20 or less. Thus, mother toner particles were prepared. Next, 100 parts of the mother toner particles were stir-mixed with additives, including 1.0 part of HDK-2000 (available from Clariant) and 1.0 part of H05TD (available from Clariant), by a HENSCHEL MIXER. Thus, an invisible toner of Example 1 was prepared. The invisible toner of Example 1 had an Mw of 11,500 and a $T_{F1/2}$ of 108 degrees C.

Structural Formula (1)

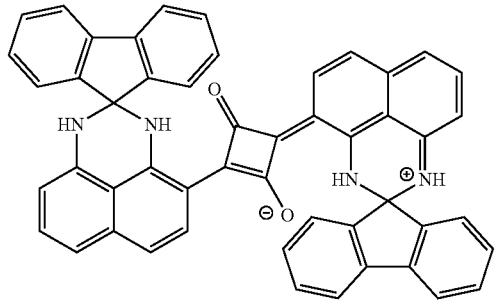

Example 2

Preparation Example 2 of Invisible Toner

The procedure for preparing the invisible toner of Example 1 was repeated except for changing the amount of the near-infrared light absorbing material from 0.5 parts by mass to 0.3 parts by mass. Thus, an invisible toner of Example 2 was prepared. The invisible toner of Example 2 had an Mw of 11,500 and a $T_{F1/2}$ of 108 degrees C.

Example 3

Preparation Example 3 of Invisible Toner

The procedure for preparing the invisible toner of Example 1 was repeated except for changing the amount of the near-infrared light absorbing material from 0.5 parts by mass to 1.0 part by mass. Thus, an invisible toner of Example 3 was prepared. The invisible toner of Example 3 had an Mw of 11,500 and a $T_{F1/2}$ of 108 degrees C.

Example 4

Preparation Example 4 of Invisible Toner

The procedure for preparing the invisible toner of Example 1 was repeated except for changing the amount of the polyester resin (RN-290 available from Kao Corporation) from 15.8 parts by mass to 10.8 parts by mass and replacing 78.9 parts by mass of the polyester resin (RN-306 available from Kao Corporation) with 83.9 parts by mass of a polyester resin (RN-300 available from Kao Corporation). Thus, an invisible toner of Example 4 was prepared. The invisible toner of Example 4 had an Mw of 6,300 and a $T_{F1/2}$ of 105 degrees C.

Example 5

Preparation Example 5 of Invisible Toner

The procedure for preparing the invisible toner of Example 1 was repeated except for changing the amount of the polyester resin (RN-290 available from Kao Corporation) from 15.8 parts by mass to 57.6 parts by mass and replacing 78.9 parts by mass of the polyester resin (RN-306 available from Kao Corporation) with 37.1 parts by mass of a polyester resin (RLC-16 available from Kao Corporation). Thus, an invisible toner of Example 5 was prepared. The invisible toner of Example 5 had an Mw of 11,800 and a $T_{F1/2}$ of 119 degrees C.

Example 6

Preparation Example 6 of Invisible Toner

The procedure for preparing the invisible toner of Example 1 was repeated except for changing the amount of the polyester resin (RN-290 available from Kao Corporation) from 15.8 parts by mass to 94.7 parts by mass and eliminating the polyester resin (RN-306 available from Kao Corporation). Thus, an invisible toner of Example 6 was prepared. The invisible toner of Example 6 had an Mw of 48,600 and a $T_{F1/2}$ of 129 degrees C.

Example 7

Preparation Example 7 of Invisible Toner

The procedure for preparing the invisible toner of Example 1 was repeated except for replacing 15.8 parts by mass of the polyester resin (RN-290 available from Kao Corporation) with 84.2 parts by mass of a polyester resin (RN-289 available from Kao Corporation) and changing the amount of the polyester resin (RN-306 available from Kao Corporation) from 78.9 parts by mass to 10.5 parts by mass. Thus, an invisible toner of Example 7 was prepared. The invisible toner of Example 7 had an Mw of 9,200 and a $T_{F1/2}$ of 99 degrees C.

Comparative Example 1

Production Example 8 of Invisible Toner

The procedure for preparing the invisible toner of Example 1 was repeated except for changing the amount of the near-infrared light absorbing material from 0.5 parts by mass to 0.2 parts by mass. Thus, an invisible toner of Comparative Example 1 was prepared. The invisible toner of Comparative Example 1 had an Mw of 11,500 and a $T_{F1/2}$ of 108 degrees C.

Comparative Example 2

Production Example 9 of Invisible Toner

The procedure for preparing the invisible toner of Example 1 was repeated except for changing the amount of the near-infrared light absorbing material from 0.5 parts by mass to 1.2 parts by mass. Thus, an invisible toner of Comparative Example 2 was prepared. The invisible toner of Comparative Example 2 had an Mw of 11,500 and a $T_{F1/2}$ of 108 degrees C.

Comparative Example 3

Production Example 10 of Invisible Toner

The procedure for preparing the invisible toner of Example 1 was repeated except for changing the near-infrared light absorbing material from the squarylium dye having the structural formula (1) to a naphthalocyanine dye (FDN-007 available from YAMADA CHEMICAL CO., LTD.). Thus, an invisible toner of Comparative Example 3 was prepared. The invisible toner of Comparative Example 3 had an Mw of 11,500 and a $T_{F1/2}$ of 108 degrees C.

Comparative Example 4

Preparation Example 11 of Invisible Toner

Preparation Example of Low-Molecular-Weight Styrene Resin A1

Into an autoclave equipped with a stirrer, a heater, a cooler, a thermometer, and a dropping pump and controlled at 210 degrees C., a monomer mixture in which 100 parts by mass of styrene (St) and 0.5 parts by mass of di-t-butyl peroxide were uniformly mixed was continuously added over a period of 30 minutes. The mixture was held at 210 degrees C. for 30 minutes to undergo a bulk polymerization. Thus, a solvent-free low-molecular-weight styrene resin A1 was prepared. The low-molecular-weight styrene resin A1 had an Mw of 5,100.

Preparation Example of High-Molecular-Weight Styrene Resin B1

In a container equipped with a stirrer and a dropping pump, 1 part by mass of sodium dodecylbenzene sulfonate (NEOGEN R available from DKS Co., Ltd.) as an anionic emulsifier was stirred and dissolved in 27 parts by mass of deionized water. Next, a monomer mixture containing 75 parts by mass of styrene (St), 25 parts by mass of butyl acrylate (BA), and 0.05 parts by mass of divinylbenzene (DVB) was dropped therein while being stirred. Thus, a monomer emulsion was prepared.

Next, a pressure-resistant reaction vessel equipped with a stirrer, a pressure gauge, a thermometer, and a dropping pump was charged with 120 parts by mass of deionized water. The internal air was replaced with nitrogen gas, then the temperature was raised to 80 degrees C., and 15% by mass of the monomer emulsion was added to the vessel. Furthermore, 1 part by mass of a 2% by mass aqueous solution of potassium persulfate was added to the vessel to cause an initial polymerization at 80 degrees C. After completion of the initial polymerization, the temperature was raised to 85 degrees C., and the remaining monomer emulsion and 4 parts by mass of the 2% by mass aqueous solution of potassium persulfate were added to the vessel over a period of 3 hours. The vessel was thereafter held at the same temperature for 2 hours. Thus, an aqueous dispersion of a high-molecular-weight styrene resin B1, which is a styrene-acrylic resin having an average particle diameter of 130 nm, having a solid content concentration of 40% by mass was prepared. The polymerization reaction proceeded stably, and the polymerization conversion rate of the resulting resin was also high. The resin was separated from the aqueous dispersion by an ultracentrifuge. The molecular weight Mw of the resin measured by GPC was 970,000.

The procedure for preparing the invisible toner of Example 1 was repeated except for replacing 15.8 parts by mass of the polyester resin (RN-290 available from Kao Corporation) and 78.9 parts by mass of the polyester resin (RN-306 available from Kao Corporation) with 88.9 parts by mass of the low-molecular-weight styrene resin A1 and 5.8 parts of the high-molecular-weight styrene resin B1, replacing the synthetic ester wax (WEP-5 available from NOF CORPORATION) with a paraffin wax (HNP-9 available from Nippon Seiro Co., Ltd.), and changing the amount of the near-infrared light absorbing material having the structural formula (1) from 0.5 parts by mass to 0.3 parts by mass. Thus, an invisible toner of Example 4 was prepared.

The invisible toner of Comparative Example 4 had an Mw of 53,000 and a $T_{F1/2}$ of 116.2 degrees C.

Preparation of Color Toner

Preparation Example 1 of Color Toner

The procedure for preparing the invisible toner of Example 1 was repeated except for replacing the near-infrared light absorbing material with perylene black as a colorant. Thus, a black color toner was prepared.

Preparation Example 2 of Color Toner

The procedure for preparing the black color toner was repeated except for changing the colorant to C.I. Pigment Yellow 74. Thus, a yellow color toner was prepared.

As a magenta colorant, C.I. Pigment Red 122 was used.

As a cyan colorant, C.I. Pigment Blue 15:3 was used.

Preparation Example 3 of Color Toner

The procedure for preparing the black color toner was repeated except for changing the colorant to C.I. Pigment Red 122. Thus, a magenta color toner was prepared.

Preparation Example 4 of Color Toner

The procedure for preparing the black color toner was repeated except for changing the colorant to C.I. Pigment Blue 15:3. Thus, a cyan color toner was prepared.

Preparation of Two-Component Developer

Preparation Example of Carrier A

A mixture of 100 parts by mass of a silicone resin (organo straight silicone), 100 parts by mass of toluene, 5 parts by mass of γ-(2-aminoethyl)aminopropyl trimethoxysilane, and 10 parts of a carbon black was subjected to a dispersion treatment by a HOMOMIXER for 20 minutes to prepare a coating layer forming liquid. Manganese (Mn) ferrite particles (having a weight average particle diameter of 35 μm) as core materials were coated with the coating layer forming liquid using a fluidized bed coating device while controlling the temperature inside the fluidized bed to 70 degrees C., followed by drying, so that the coating layer was formed on the surface of the core materials with an average film thickness of 0.20 μm. The core materials having the coating layer was burnt in an electric furnace at 180 degrees C. for 2 hours. Thus, a carrier A was prepared.

Preparation Example of Two-Component Developer

Each of the above-prepared invisible toners and color toners was uniformly mixed with the carrier A by a TURBULA MIXER (available from Willy A. Bachofen (WAB)) at a revolution of 48 rpm for 5 minutes to be charged. Thus, a two-component developer was prepared. The toner and the carrier A were mixed so that the toner concentration became 7% by mass.

In a digital full-color multifunction peripheral IMAGIO NEO C600 manufactured by Ricoh Company, Ltd. containing black developer, yellow developer, magenta developer, and cyan developer, the black developer was replaced with each of the two-component developers 1 to 12, so that the multifunction peripheral was equipped with a toner set including an invisible toner and color toners.

The absorbance of each of yellow, magenta, and cyan toners contained in the yellow, magenta, and cyan developers, respectively, at a wavelength of 800 nm or more was less than 0.01.

Chroma C*, Hue Angle h, and Spectral Reflectance of Toner in Pellet Form

Each of the above-prepared toners in an amount of 3.0 g was formed into a pellet having a diameter of 40 mm, as a measurement specimen, by a molding machine (BRE-32 available from MAEKAWA TESTING MACHINE MFG. Co., Ltd., with a pressing device load of 6 Mpa and a pressing time of 1 minute).

The chroma C* and the hue angle h of each pellet was measured with a spectrophotometer (X-Rite eXact available from X-Rite Inc., status A, m0 light source). The spectral reflectance of each pellet can be measured with a spectrophotometer (V-660 available from JASCO Corporation, equipped with an ISN-723 integrating sphere unit).

Chroma C*, Hue Angle h, and Spectral Reflectance of Solid Image

After removing the fixing unit from the digital full-color multifunction peripheral (IMAGIO NEO C600 manufactured by Ricoh Company, Ltd.), an unfixed solid patch of 5 cm×5 cm was output thereby. The solid patch was cut out with scissors to prepare a cutout piece. The mass of the cutout piece was measured with a precision balance. After the toner in the solid patch portion (unfixed image portion) was blown off with an air gun, the mass of the cutout piece was measured again. The toner deposition amount was calculated from the mass of the cutout piece before and after the toner had been blown off by the air gun according to the following formula (1).

$$\text{Toner Deposition Amount (mg/cm}^2\text{)}=((\text{Mass of Cutout Piece with Solid Patch})-(\text{Mass of Cutout Piece after Blowing of Toner}))/25 \quad \text{Formula (1)}$$

The development conditions were adjusted while measuring the deposition amount by the above-described method. After adjusting the adhesion amount to 0.60 mg/cm', a solid image was output on a sheet of POD GLOSS PAPER (available from Oji Paper Co., Ltd.) under the adjusted development condition and the fixing temperature of 180 degrees C.

The chroma C*, the hue angle h, and the spectral reflectance of the solid image were measured in the same manner as those of the pellet.

Next, "invisibility of invisible toner", "readability of invisible toner", and "difference in gloss value" were evaluated as follows. The results are presented in Tables 1 and 2 below.

Invisibility of Invisible Toner

Figure 13:
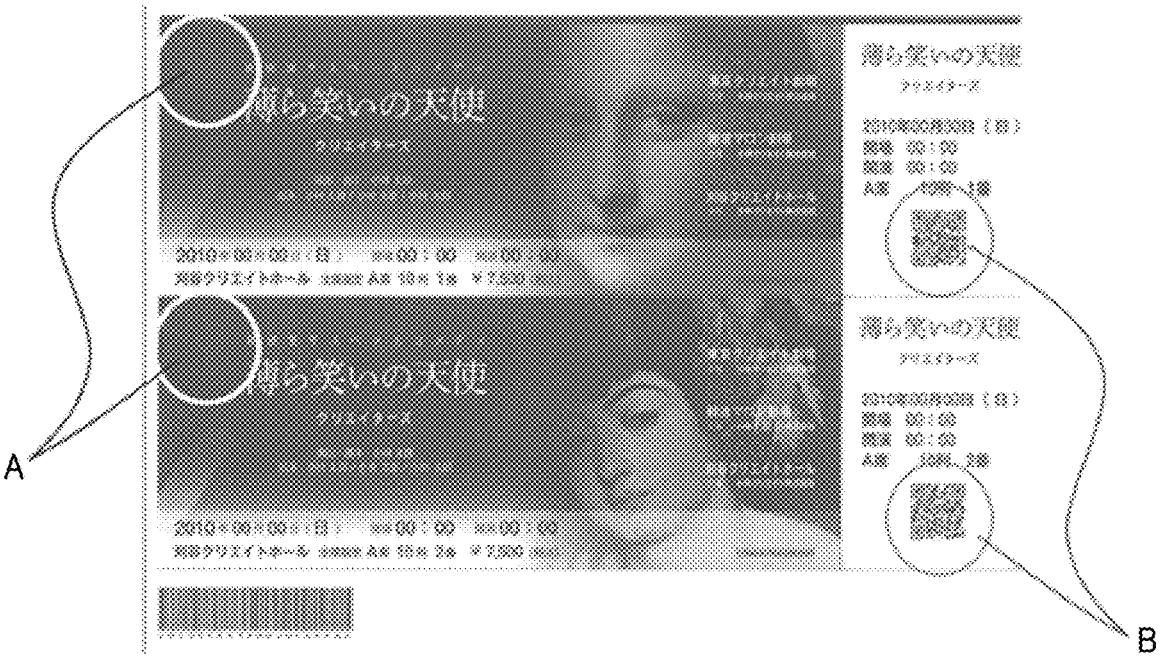
FIG. 13 is a diagram in which an invisible toner image and a color toner image are superimposed, output in Examples.

A QR code (registered trademark) was printed with each of the above-prepared invisible toners on the area A where the entire area was colored, as illustrated in FIG. 13, using the digital full-color multifunction peripheral.

Further, a QR code was printed with the invisible toner on the area B illustrated in FIG. 13 using the digital full-color multifunction peripheral. Further, another QR code containing information different from that contained in the QR code printed with the invisible toner was further printed thereon with the color toner.

The areas A and B illustrated in FIG. 13 were visually observed by 20 randomly-selected human monitors. Invisibility of invisible toner was evaluated by the number of persons who were able to visually identify the QR code printed on the areas A and B with the invisible toner, based on the following evaluation criteria. The results are presented in Tables 1 and 2.

Evaluation Criteria

A: 2 or less

B: from 3 to 5

C: 6 or more

Readability of Invisible Toner

A QR code was printed with each invisible toner using the digital full-color multifunction peripheral. Further, patterns illustrated in FIG. 14A were printed with the above-prepared color toners on the QR code printed with the invisible toner.

The QR code printed with the invisible toner is colorless and transparent, which is not directly visible. When the QR code is visualized and the patterns are printed thereon with the color toners, patterns illustrated in FIG. 14B are obtained.

Figure 14A:
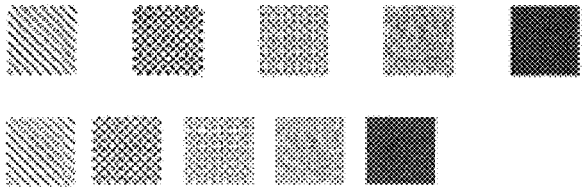
FIG. 14A is a diagram of a color toner image, output in Examples.
Figure 14B:
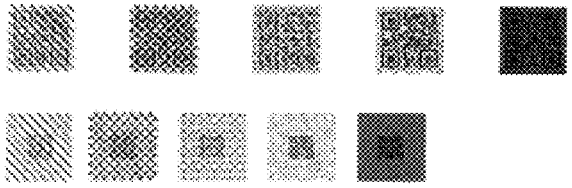
FIG. 14B is a diagram in which an invisible toner image and a color toner image are superimposed, output in Examples.

Ten sheets of the printed matter illustrated in FIG. 13 and ten sheets of the printed matter illustrated in FIG. 14A were prepared. The QR code printed with the invisible toner on each printed matter was read by a two-dimensional bar code reader, and "readability of invisible toner" was evaluated based on the following evaluation criteria.

As the two-dimensional bar code reader, a device named CM-2D200K2B (available from A-POC corporation) was used equipped with a 870 nm BAND PASS FILTER (available from CERATECH JAPAN Co., Ltd.) for selectively transmitting near-infrared light of 870 nm. The results are presented in Tables 1 and 2.

Evaluation Criteria

A: All QR codes were readable in one scan.

B: All QR codes were readable, but at least one QR code required two scans or more.

C: One or more QR codes were unreadable.

Difference in Gloss Value

A fixed solid patch of 5 cm×5 cm was output by the digital full-color multifunction peripheral, and subjected to a measurement of gloss value by a gloss meter (VGS-1D available from Nippon Denshoku Industries Co., Ltd.) at four points. The gloss values at four points were averaged. The gloss value of a white paper portion was measured in the same manner. Next, the difference (degrees C.) between the average gloss value at four points on the solid patch and the gloss value of the white paper portion was determined and evaluated as "difference in gloss value". When the difference in gloss value is less than 15 degrees C., it is a practicable level. It is more preferable that the difference in gloss value be less than 10 degrees C.

TABLE 1

| | | Examples | | | | | | |
|---|---|---|---|---|---|---|---|---|
| | | 1 | 2 | 3 | 4 | 5 | 6 | 7 |
| Binder Resin | Polyester Resin (RN-290) | 15.8 | 15.8 | 15.8 | 10.8 | 57.6 | 94.7 | — |
| | Polyester Resin (RN-306) | 78.9 | 78.9 | 78.9 | — | — | — | 10.5 |
| | Polyester Resin (RN-300) | — | — | — | 83.9 | — | — | — |
| | Polyester Resin (RLC-16) | — | — | — | — | 37.1 | — | — |
| | Polyester Resin (RN-289) | — | — | — | — | — | — | 84.2 |
| | Styrene Resin A1 (low molecular weight) | — | — | — | — | — | — | — |
| | Styrene Resin B1 (high molecular weight) | — | — | — | — | — | — | — |
| Near-infrared Light Absorbing Material | Squarylium Dye having Structural Formula (1) | 0.5 | 0.3 | 1.0 | 0.5 | 0.5 | 0.5 | 0.5 |
| | FDN-007 | — | — | — | — | — | — | — |
| Release Agent | Synthetic Ester Wax (WEP-5) | 5.3 | 5.3 | 5.3 | 5.3 | 5.3 | 5.3 | 5.3 |
| | Paraffin Wax (HNP-9) | — | — | — | — | — | — | — |
| | Total (parts by mass) | 100.5 | 100.3 | 101.0 | 100.5 | 100.5 | 100.5 | 100.5 |
| Toner in Pellet Form | Chroma C* | 13.2 | 6.3 | 18.9 | 13.8 | 13.2 | 13.5 | 13.3 |
| | Hue Angle h (degree) | 76.6 | 53.1 | 87.9 | 76.7 | 76.5 | 76.5 | 76.8 |
| | Spectral Reflectance (%) | 3.9 | 4.8 | 1.8 | 2.8 | 2.8 | 2.7 | 2.7 |
| Solid Image | Chroma C* | 8.2 | 2.24 | 18.57 | 8.2 | 8.1 | 8.3 | 8.2 |
| | Hue Angle h (degree) | 79.8 | 56.03 | 87.53 | 79.7 | 79.8 | 79.6 | 79.2 |
| | Spectral Reflectance (%) | 8.4 | 31.7 | 5 | 8.3 | 8.6 | 8.4 | 8.4 |
| Weight Average Molecular Weight (Mw) | | 11461 | 11461 | 11461 | 6301 | 11840 | 48606 | 9230 |
| ½ Outflow Temperature $T_{F1/2}$ | | 107.6 | 107.6 | 107.6 | 105.2 | 119.1 | 128.6 | 99.1 |
| Evaluation Results | Invisibility | A | A | A | A | A | B | B |
| | Readability | A | A | A | A | A | A | A |
| | Difference in Gloss Value (degrees) | 4 | 5 | 3 | 9 | 8 | 11 | 14 |

TABLE 2

| | | Comparative Examples | | | |
|---|---|---|---|---|---|
| | | 1 | 2 | 3 | 4 |
| Binder Resin | Polyester Resin (RN-290) | 15.8 | 15.8 | 15.8 | — |
| | Polyester Resin (RN-306) | 78.9 | 78.9 | 78.9 | — |
| | Polyester Resin (RN-300) | — | — | — | — |
| | Polyester Resin (RLC-16) | — | — | — | — |
| | Polyester Resin (RN-289) | — | — | — | — |
| | Styrene Resin A1 (low molecular weight) | — | — | — | 88.9 |
| | Styrene Resin B1 (high molecular weight) | — | — | — | 5.8 |
| Near-infrared Light Absorbing Material | Squarylium Dye having Structural Formula (1) | 0.2 | 1.2 | — | 0.3 |
| | FDN-007 | — | — | 0.5 | — |
| Release Agent | Synthetic Ester Wax (WEP-5) | 5.3 | 5.3 | 5.3 | — |
| | Paraffin Wax (HNP-9) | — | — | — | 5.3 |
| Total (parts by mass) | | 100.2 | 101.2 | 100.5 | 100.3 |
| Toner in Pellet Form | Chroma C* | 5.7 | 20.1 | 32.5 | 5.6 |
| | Hue Angle h (degree) | 52.6 | 88.7 | 107.8 | 48.2 |
| | Spectral Reflectance (%) | 5.3 | 1.6 | 5.7 | 4.8 |

TABLE 2-continued

| | | Comparative Examples | | | |
|---|---|---|---|---|---|
| | | 1 | 2 | 3 | 4 |
| Solid Image | Chroma C* | 1.98 | 20.08 | 20.93 | 2.11 |
| | Hue Angle h (degree) | 53.94 | 79.19 | 106.47 | 49 |
| | Spectral Reflectance (%) | 40.9 | 5 | 41.5 | 32.3 |
| Weight Average Molecular Weight (Mw) | | 11461 | 11461 | 11461 | 53000 |
| ½ Outflow Temperature $T_{F1/2}$ | | 107.6 | 107.6 | 107.6 | 116.2 |
| Evaluation Results | Invisibility | A | C | C | C |
| | Readability | C | A | C | A |
| | Difference in Gloss Value (degrees) | 5 | 3 | 4 | 5 |

The invisible toners of Examples 1 to 7 are found to be excellent in invisibility and the readability.

By contrast, the invisible toners of Comparative Examples 1 to 4 were insufficient in invisibility and readability and inferior in performance to the invisible toners of Examples 1 to 7.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner, comprising:
a binder resin; and
a near-infrared light absorbing material,
wherein:
the toner in the form of a pellet has:
a chroma C* of 20 or less in the L*C*h color space,
a hue angle h of from 50 to 90 degrees in the L*C*h color space, and
a spectral reflectance of 5% or less at a wavelength of from 800 to 900 nm; and
the toner reflects visible light having a wavelength of 400 nm to 700 nm.

2. The toner according to claim 1, wherein the binder resin comprises a polyester resin.

3. The toner according to claim 1, further comprising:
an ester wax.

4. The toner according to claim 1, wherein a solid image formed of the toner with a deposition amount of 0.6 mg/cm$^2$ has:
the chroma C* of 20 or less in the L*C*h color space;
the hue angle h of from 50 to 90 degrees in the L*C*h color space; and
a spectral reflectance of 40% or less at a wavelength of from 800 to 900 nm.

5. The toner according to claim 1, wherein tetrahydrofuran-soluble matter in the toner has a weight average molecular weight Mw of from 6,000 to 12,000.

6. The toner according to claim 1, wherein the toner has a ½ outflow temperature of from 105 to 120 degrees C.

7. A toner set, comprising:
a color toner comprising a binder resin and a colorant; and
the toner according to claim 1.

8. A toner accommodating unit, comprising:
a container; and
the toner according to claim 1 accommodated in the container.

9. An image forming method, comprising:
forming an electrostatic latent image on an electrostatic latent image bearer;
developing the electrostatic latent image formed on the electrostatic latent image bearer with the toner according to claim 1 to form an invisible toner image;
transferring the invisible toner image formed on the electrostatic latent image bearer onto a surface of a recording medium; and
fixing the invisible toner image on the surface of the recording medium.

10. The image forming method according to claim 9, wherein the invisible toner image includes a solid image portion formed of the toner with a deposition amount of 0.6 mg/cm$^2$, and the solid image portion has:
the chroma C* of 20 or less in the L*C*h color space;
the hue angle h of from 50 to 90 degrees in the L*C*h color space; and
a spectral reflectance of 40% or less at a wavelength of from 800 to 900 nm.

11. The image forming method according to claim 10, wherein a difference in 60-degree gloss value between the recording medium and the solid image portion of the invisible toner image fixed on the recording medium is 10 or less.

12. The image forming method according to claim 9, wherein the recording medium comprises lignin.

13. The image forming method according claim 9, further comprising:
developing the electrostatic latent image with a color toner to form a color toner image,
wherein the invisible toner image is closer to the recording medium than the color toner image is.

14. An image forming apparatus, comprising:
an electrostatic latent image bearer;
an electrostatic latent image forming device configured to form an electrostatic latent image on the electrostatic latent image bearer;
a developing device containing the toner according to claim 1, configured to develop the electrostatic latent image formed on the electrostatic latent image bearer with the toner to form an invisible toner image;
a transfer device configured to transfer the invisible toner image formed on the electrostatic latent image bearer onto a surface of a recording medium; and
a fixing device configured to fix the invisible toner image on the surface of the recording medium.

15. The image forming apparatus according to claim 14, wherein the invisible toner image includes a solid image portion formed of the toner with a deposition amount of 0.6 mg/cm$^2$, and the solid image portion has:
the chroma C* of 20 or less in the L*C*h color space;
the hue angle h of from 50 to 90 degrees in the L*C*h color space; and a spectral reflectance of 40% or less at a wavelength of from 800 to 900 nm.

16. The image forming apparatus according to claim 15, wherein a difference in 60-degree gloss value between the recording medium and the solid image portion of the invisible toner image fixed on the recording medium is 10 or less.

17. The image forming apparatus according to claim 14, wherein the recording medium comprises lignin.

18. The image forming apparatus according claim 14, further comprising:

a color toner developing device containing a color toner, configured to develop the electrostatic latent image with the color toner to form a color toner image, wherein the invisible toner image is closer to the recording medium than the color toner image is.

19. The toner according to claim 1, which is an invisible toner.

20. The toner according to claim 1, wherein the toner reflects the visible light having the wavelength of 400 nm to 700 nm with a reflectance of at least about 50% over the wavelength of 400 nm to 700 nm, as indicated by a spectral reflectance curve of a solid image formed of the toner.

* * * * *